US012084238B2

(12) United States Patent
Flach et al.

(10) Patent No.: US 12,084,238 B2
(45) Date of Patent: Sep. 10, 2024

(54) COMPACT AUGMENTED PERMEATION SYSTEM (CAPS) ASSEMBLIES AND RELATED SYSTEMS AND METHODS

(71) Applicant: BATTELLE SAVANNAH RIVER ALLIANCE, LLC, Aiken, SC (US)

(72) Inventors: Joshua P. Flach, Aiken, SC (US); Kurt R. Eberl, Aiken, SC (US); William R. Johnson, Aiken, SC (US)

(73) Assignee: Battelle Savannah River Alliance, LLC, Aiken, SC (US)

( * ) Notice: Subject to any disclaimer, the term of this patent is extended or adjusted under 35 U.S.C. 154(b) by 0 days.

(21) Appl. No.: 17/840,754

(22) Filed: Jun. 15, 2022

(65) Prior Publication Data

US 2023/0057265 A1 Feb. 23, 2023

Related U.S. Application Data

(60) Provisional application No. 63/234,828, filed on Aug. 19, 2021.

(51) Int. Cl.

| | |
|---|---|
| ***B65D 51/16*** | (2006.01) |
| ***B65D 39/08*** | (2006.01) |
| ***B65D 51/24*** | (2006.01) |

(52) U.S. Cl.

CPC ..... *B65D 51/1616* (2013.01); *B65D 39/08* (2013.01); *B65D 51/24* (2013.01); *B65D 2205/02* (2013.01)

(58) Field of Classification Search

CPC .... B65D 51/1616; B65D 39/08; B65D 51/24; B65D 2205/02; B65D 79/0087; B65D 81/263; G21F 5/12

See application file for complete search history.

(56) References Cited

U.S. PATENT DOCUMENTS

| | | | | |
|---|---|---|---|---|
| 3,937,357 | A | 2/1976 | Burgess | |
| 4,174,784 | A | 11/1979 | Hartung | |
| 6,056,796 | A * | 5/2000 | Chiang | B01D 46/2407 55/482 |

(Continued)

FOREIGN PATENT DOCUMENTS

| | | |
|---|---|---|
| EP | 0383153 | 2/1994 |
| JP | 5594017 | 9/2014 |

(Continued)

OTHER PUBLICATIONS

International Search Report and Written Opinion for PCT/US2022/033531, dated Aug. 29, 2022, 9 pages.

(Continued)

*Primary Examiner* — Shawn M Braden
(74) *Attorney, Agent, or Firm* — Dority & Manning, P.A.

(57) ABSTRACT

In one aspect, a compact augmented permeation system (CAPS) assembly includes a housing defining an interior cavity. The housing further defines a gas inlet for receiving gas within the interior cavity and a gas outlet for expelling the gas from the interior cavity. Additionally, the CAPS assembly includes a gas-permeable membrane positioned within the housing and defining a system boundary across the interior cavity such that gas received within the interior cavity via the gas inlet permeates through the gas-permeable membrane before being expelled from the interior cavity via the gas outlet.

20 Claims, 12 Drawing Sheets

(56) References Cited

U.S. PATENT DOCUMENTS

| | | | | |
|---|---|---|---|---|
| 6,248,153 | B1 | 6/2001 | Braun et al. | |
| 11,370,585 | B2 | 6/2022 | Shah et al. | |
| 2009/0255932 | A1 | 10/2009 | Waanders et al. | |
| 2012/0266590 | A1* | 10/2012 | Janes | F15B 1/14 137/15.01 |
| 2020/0216236 | A1 | 7/2020 | Shah et al. | |
| 2021/0016657 | A1 | 1/2021 | Matsuura et al. | |

FOREIGN PATENT DOCUMENTS

| | | |
|---|---|---|
| JP | 5913073 | 4/2016 |
| JP | 6242263 | 12/2017 |

OTHER PUBLICATIONS

Hagler et al. "Estimating Hydrogen Gas Concentration in the Void Spaces of Type AF Radioactive. Material (RAM) Transport Packages" *PATRAM* LLNL-CONF-778677 (2019) pp. 1-13.

Kluiters, S.C.A. "Status review on membrane systems for hydrogen separation" *EU Project MIGREYD NNE5-2001-670* ECN-C-04-102 (2004) pp. 1-29.

Gardner et al., "Humidity Tolerant Hydrogen-Oxygen Recombination Catalysts for Hydrogen Safety Applications". Chemical Engineering Branch, Canadian Nuclear Laboratories, 8 pages.

W.L. Robb, "Thin Silicone Membranes—Their Permeation Properties and some Applications", General Electric Company, 19 pages.

Shepelin V., "Catalysts for Hydrogen Removal: Kinetic Paradox and Functioning at High Concentration of Hydrogen", CJSC ISP Company, "Russian Energy Technology", 12 pages.

* cited by examiner

COMPACT AUGMENTED PERMEATION SYSTEM (CAPS) ASSEMBLIES AND RELATED SYSTEMS AND METHODS

CROSS-REFERENCE TO RELATED APPLICATIONS

The present application is based upon and claims the right of priority to U.S. Provisional Patent Application No. 63/234,828, filed on Aug. 19, 2021, the disclosure of which is hereby incorporated by reference herein in its entirety for all purposes.

FEDERAL RESEARCH STATEMENT

This invention was made with Government support under Contract No. 89303321CEM000080, awarded by the U.S. Department of Energy. The Government has certain rights in the invention.

FIELD OF THE INVENTION

The present subject matter relates generally to permeation systems and, more particularly, compact augmented permeation system (CAPS) assemblies and related systems and methods for augmenting the permeation of gases from a sealed system (e.g., a sealed storage container).

BACKGROUND OF THE INVENTION

Approximately three million radioactive material shipments are made every year in the United States. Hazardous material shipping/storage containers must ensure dangerous conditions (e.g., combustible hydrogen atmospheres) are not reached as a condition of use. Continuous venting of gases is prohibited for Type A Fissile/Type B shipping containers in accordance with certain federal regulations, including 10 CFR § 71.43(h), but permeation of gases through packaging materials of construction is permitted in accordance with guidance from ANSI N14.5. In most cases, permeation occurs slowly relative to the generation of gases within sealed storage containers, especially at low temperatures.

As such, there is a need for a system that augments the safe, effective, and efficient permeation of gases from storage containers, particularly those used for shipping/storing hazardous materials.

BRIEF DESCRIPTION OF THE INVENTION

Aspects and advantages of the invention will be set forth in part in the following description, may be obvious from the description, or may be learned through practice of the invention.

In one aspect, the present subject matter is directed to a compact augmented permeation system (CAPS) assembly. The CAPS assembly includes a housing defining an interior cavity. The housing further defines a gas inlet for receiving gas within the interior cavity and a gas outlet for expelling the gas from the interior cavity. Additionally, the CAPS assembly includes a gas-permeable membrane positioned within the housing and defining a system boundary across the interior cavity such that gas received within the interior cavity via the gas inlet permeates through the gas-permeable membrane before being expelled from the interior cavity via the gas outlet. The gas-permeable membrane includes an inner surface and an opposed outer surface, with the inner surface of the gas-permeable membrane having a non-planar configuration as the gas-permeable membrane extends across the interior cavity defined by the housing.

In another aspect, the present subject matter is directed to a material storage system. The system includes a storage container defining an opening, and a compact augmented permeation system (CAPS) assembly configured to be installed relative to the opening of the storage container. The CAPS assembly includes a housing defining an interior cavity, with the housing further defining a gas inlet for receiving gas within the interior cavity and a gas outlet for expelling the gas from the interior cavity. Additionally, the CAPS assembly includes a gas-permeable membrane positioned within the housing and defining a system boundary across the interior cavity such that gas received within the interior cavity via the gas inlet permeates through the gas-permeable membrane before being expelled from the interior cavity via the gas outlet. Moreover, the housing of the CAPS assembly is configured to be removably coupled to the storage container to allow the CAPS assembly to be transitioned between installed and uninstalled states relative to the storage container.

In a further aspect, the present subject matter is directed to a compact augmented permeation system (CAPS) assembly. The CAPS assembly includes a housing defining an interior cavity. The housing further defines a gas inlet for receiving gas within the interior cavity and a gas outlet for expelling the gas from the interior cavity. Additionally, the CAPS assembly includes a gas-permeable membrane positioned within the housing. At least a portion of the gas-permeable membrane is movable relative to the housing between a sealed position, at which the gas-permeable membrane defines a system boundary across the interior cavity such that gas received within the interior cavity via the gas inlet permeates through the gas-permeable membrane before being expelled from the interior cavity via the gas outlet, and a venting position, at which the gas is allowed to flow around a portion of the gas-permeable membrane without permeating therethrough.

In an even further aspect, the present subject matter is directed to a compact augmented permeation system (CAPS) assembly configured in accordance with one or more embodiments described herein.

These and other features, aspects, and advantages of the present invention will become better understood with reference to the following description and appended claims. The accompanying figures, which are incorporated in and constitute a part of this specification, illustrate embodiments of the invention and, together with the description, serve to explain the principles of the invention.

BRIEF DESCRIPTION OF THE FIGURES

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
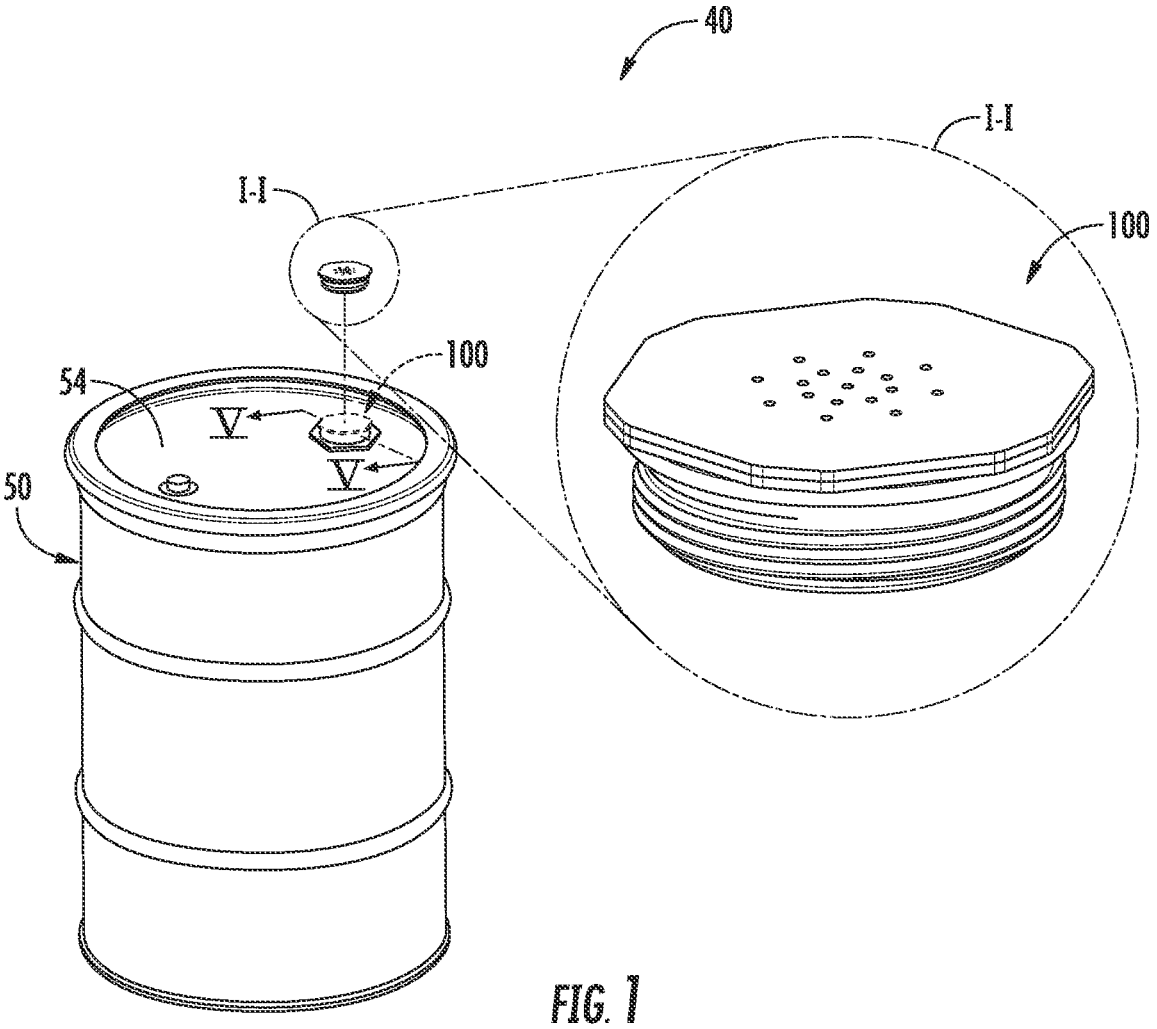
FIG. 1 illustrates a perspective view of one embodiment of a material storage system in accordance with aspects of the present subject matter, particularly illustrating a compact augmented permeation system (CAPS) assembly of the material storage system in both installed and un-installed states relative to a storage container of the material storage system.

Reference now will be made in detail to embodiments of the invention, one or more examples of which are illustrated in the figures. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to a compact augmented permeation system (CAPS) assembly for augmenting the permeation of gases therethrough. In several embodiments, the CAPS assembly may be configured to be removably coupled to a sealed, non-vented storage container within which hazardous materials are stored such that the CAPS assembly provides a safe, effective, and efficient means for augmenting permeation of gases from the storage container.

In one exemplary embodiment, the CAPS assembly may include a solid, continuous, gas-permeable membrane that may be fixed or supported relative to a support structure, which can be used to accelerate permeation of gases from a sealed system. The CAPS assembly can prevent the transfer of liquids, solids, and aerosols across the membrane but still allow permeation of gases (e.g., when an unequal partial pressure exists across the membrane). The CAPS assembly may be used to transfer unwanted gases across a system boundary in circumstances, including radioactive material packaging applications, where venting though a continuous gas channel cannot occur. The CAPS assembly may be particularly beneficial in the shipping and storage industries.

In exemplary aspects, embodiments of the CAPS assembly can accelerate the rate of permeation for gases from a sealed system while maintaining a continuous membrane across the system boundary. In several embodiments, gases within the system must permeate through the membrane to exit the system boundary. Embodiments of the CAPS assembly can prevent the transfer of solids, liquids, and aerosols, yet allow for the transfer of gases. The CAPS assembly can include a continuous, solid gas-permeable membrane that seals the system boundary in certain embodiments. Embodiments can be configured such that there are no apparent leak paths across the system boundary.

In certain embodiments, the material and geometry (including the surface area and thickness) of the continuous membrane may be modified to increase or decrease the permeation rate of a gas through the membrane. In certain embodiments, the surface area and, therefore, the permeation rate, may be increased by incorporating three-dimensional features in the membrane that increase surface area but maintain a compact outer profile. In certain embodiments, the material and geometry (including the surface area and thickness) of the continuous membrane may be modified to withstand application-specific load conditions, including increased/decreased pressure, vibration, temperature conditions, and impact loading. In certain embodiments, the continuous membrane can be fixed to or braced by a support material on one or both sides. In certain embodiments, the material and geometry of the support material may be modified to increase structural performance during application-specific load conditions including increased/decreased pressure, vibration, temperature conditions, and impact loading.

In certain embodiments, the support material can be porous, including sintered metal or metal foam, which facilitates the adhesion of the membrane to the structural material without impeding the flow of gases to the membrane. Other materials may be used as well. In certain embodiments, the porous support material can filter gases from particulate or liquids, which may otherwise degrade or reduce the performance of the membrane through chemical reactions or abrasion. In certain embodiments, the porosity of the support material may be modified to filter various liquids and particulate based on application-specific needs. In certain embodiments, the support material, if used on both sides of the membrane, can be of mirrored geometry, which reduces fabrication expenses. In certain embodiments, a catalyst may be incorporated in the porous support material to further accelerate permeation of gases from a system.

In certain exemplary embodiments, the membrane and support material, if used, may be enclosed in a housing for structural integrity of the system and for integration with systems where the CAPS assembly may be used. In certain embodiments, the housing can be crimped, riveted, bolted, glued, or otherwise enclosed. Other constructions may be used as well. In certain embodiments, the materials of the membrane, support material, and housing can be modified to ensure chemical compatibility between the CAPS assembly and media within a sealed system. In certain embodiments, heat-generating features may be used to increase the temperature of the membrane and accelerate gas permeation at low air temperatures.

In certain embodiments, the CAPS assembly may be compact. In certain embodiments, the housing can be designed with features, including bolts, rivets, and screw threads, that facilitate integration with existing systems, including shipping and storage containers.

In certain exemplary aspects, embodiments of the CAPS assembly can accelerate gas permeation at all temperature conditions. Additionally, in certain embodiments, the CAPS assembly may include a pressure relief feature to vent gases from a sealed system above a set or design pressure.

By way of example, embodiments of the present subject matter may be used for the mitigation of flammable gas generation, including hydrogen gas generation, within radioactive material (RAM) shipping packages. Venting is commonly used in the shipping industry to relieve gases within a container to prevent a flammable gas mixture from being generated. The RAM shipping industry is unique in that Type A Fissile and Type B packaging are explicitly prohibited from "continuously venting during transport" in accordance with federal regulations, such as 10 CFR § 71.43(h). In certain embodiments, the CAPS assembly may allow for the permeation of gases without being considered as including a vent. As such, the CAPS assembly may provide a unique, inexpensive solution to mitigate flammable gas generation in both transportation and storage.

By way of example, embodiments of the present subject matter may be used for the mitigation of pressure increases from gases. This is important as to control the pressure within the shipping package containment vessels to assure the pressure specifications of the design are not exceeded. Pressure increases may occur as a result of gas generation or pressure increases resulting from temperature excursions. Gas generation may be caused by radiolysis, chemical reactions, temperature-related material degradation effects of plastics and other materials of construction, or other processes. Temperature excursions in RAM packages may result from the heat from decay of the radioactive material being shipped, from insolation, from normal or hypothetical conditions of transport, or other conditions. The CAPS assembly may provide a unique, inexpensive solution to mitigate gas pressure increases in both transportation and storage.

In at least one anticipated design of an embodiment, calculations to determine the rate of permeation of hydrogen gas at various pressures demonstrate a high rate of permeation under low pressure. The rate of permeation exceeds the anticipated hydrogen generation rate for this embodiment and would eliminate the possibility of a flammable atmosphere occurring.

Referring now to the figures, FIG. 1 illustrates a perspective view of one embodiment of a material storage system 40, including a compact augmented permeation system (CAPS) assembly 100 in accordance with aspects of the present subject matter, particularly illustrating an exemplary application in which the CAPS assembly 100 may be used within the system 40 to augment the permeation of gases from a storage container 50 of the material storage system 40. Specifically, FIG. 1 illustrates the CAPS assembly 100 in both an installed state (as shown in dashed lines) and an uninstalled state (as shown in solid lines) relative to the storage container 50, with the CAPS assembly 100 being exploded away from the container 50 in the uninstalled state. Additionally, callout I-I shown in FIG. 1 provides a zoomed-in or magnified view of the CAPS assembly 100 in its uninstalled state.

In several embodiments, the CAPS assembly 100 may be configured for use with a storage vessel or container, such as the storage container 50 shown in FIG. 1 (e.g., a storage drum). For instance, the container 50 may, in certain embodiments, be configured to contain hazardous materials, such as radioactive materials (RAM). In such embodiments, the CAPS assembly 100 may be configured to be installed relative to the storage container 50 to augment the permeation of gases generated within the container 50 (e.g., hydrogen or other gases).

In several embodiments, the CAPS assembly 100 may be configured to be installed within an opening or other inlet/outlet of the associated storage container. For instance, in the illustrated embodiment, the CAPS assembly 100 may be used as a replacement for the standard cap or plug typically utilized to seal an opening 52 (FIG. 5) defined in the storage container 50 (e.g., the opening defined through the upper wall of the storage container 50). In such an embodiment, the CAPS assembly 100 may be configured to seal against an adjacent outer surface 54 (see also FIG. 5) of the container 50 around the perimeter of the opening 52 such that the container 50 and the CAPS assembly 100 collectively define a sealed system boundary for the media contained therein. Gases generated by the contained media may then be allowed to cross the system boundary via permeation through an associated gas-permeable membrane of the CAPS assembly 100.

In several embodiments, the CAPS assembly 100 may be configured to be selectively or removably coupled to the associated storage container 50. For instance, as will be described in greater detail below, the CAPS assembly 100 may include an outer housing that includes threads or is otherwise threaded to allow the CAPS assembly 100 to be threaded into a corresponding threaded opening of the storage container 50 (e.g., opening 52—see FIG. 5). As a result, the CAPS assembly 100 can be quickly and easily installed relative to and removed from the container 50. However, as an alternative to a threaded connection, the CAPS assembly 100 may be configured to be selectively or removably coupled to the container 50 using any other suitable means, such as a press-fit connection or by using fasteners. Alternatively, in other embodiments, the CAPS assembly 100 may be configured to be more permanently coupled to the storage container 50, such as by welding the CAPS assembly 100 to the container 50 or by using suitable adhesives.

It should be appreciated that the storage container 50 shown in FIG. 1 is simply illustrated to provide an example storage container with which the disclosed CAPS assembly 100 may be used in accordance with aspects of the present subject matter. In general, the CAPS assembly 100 may be used with any suitable storage container having any suitable container configuration that allows the CAPS assembly 100 to generally function as described herein. For instance, suitable storage containers may include shipping containers, temporary or permanent storage vessels, and/or the like. Additionally, the material storage system 40 disclosed herein may be used for the storage of materials at a given location or during shipping of such materials.

Figure 2:
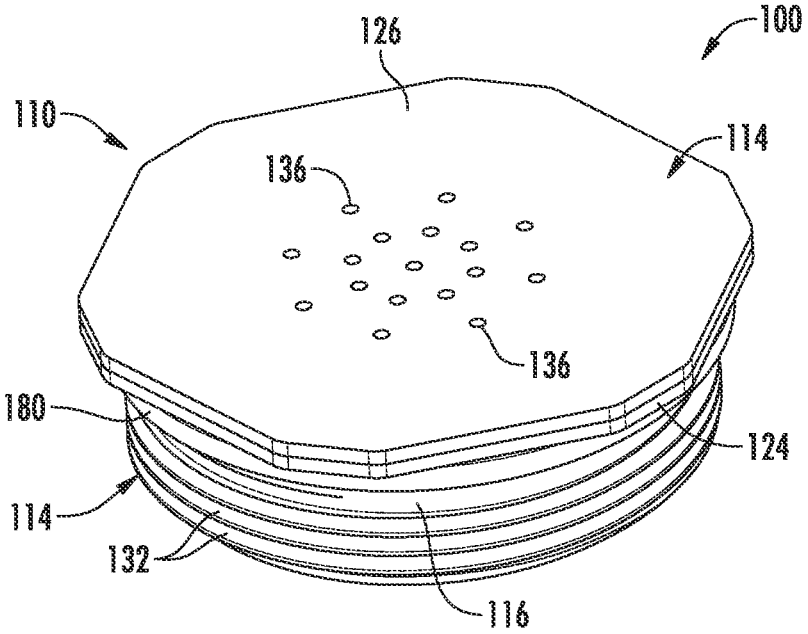
FIG. 2 illustrates a perspective view of one embodiment of the CAPS assembly shown in FIG. 1 in accordance with aspects of the present subject matter.
Figure 3:
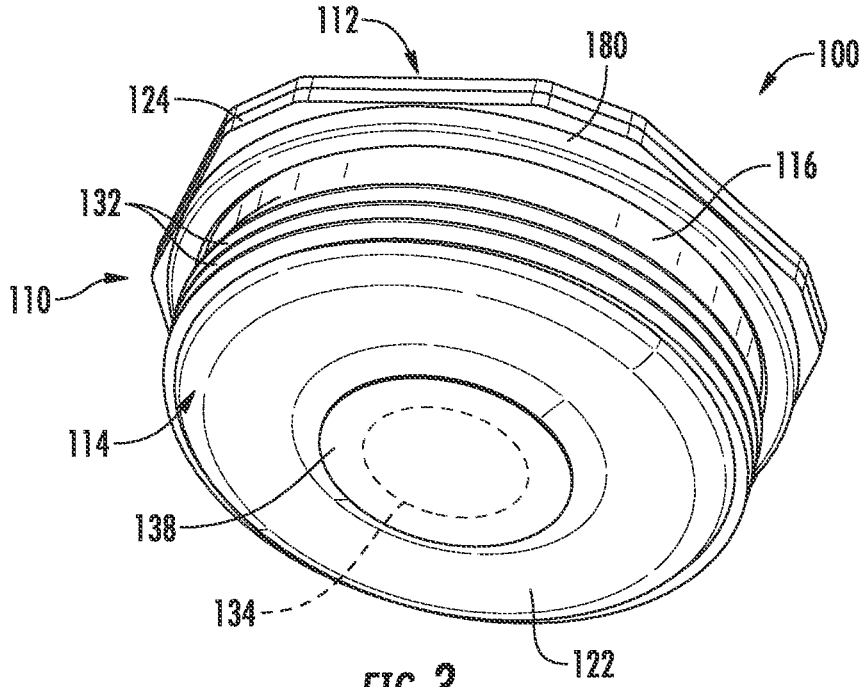
FIG. 3 illustrates another perspective view of the CAPS assembly shown in FIG. 2 in accordance with aspects of the present subject matter.
Figure 4:
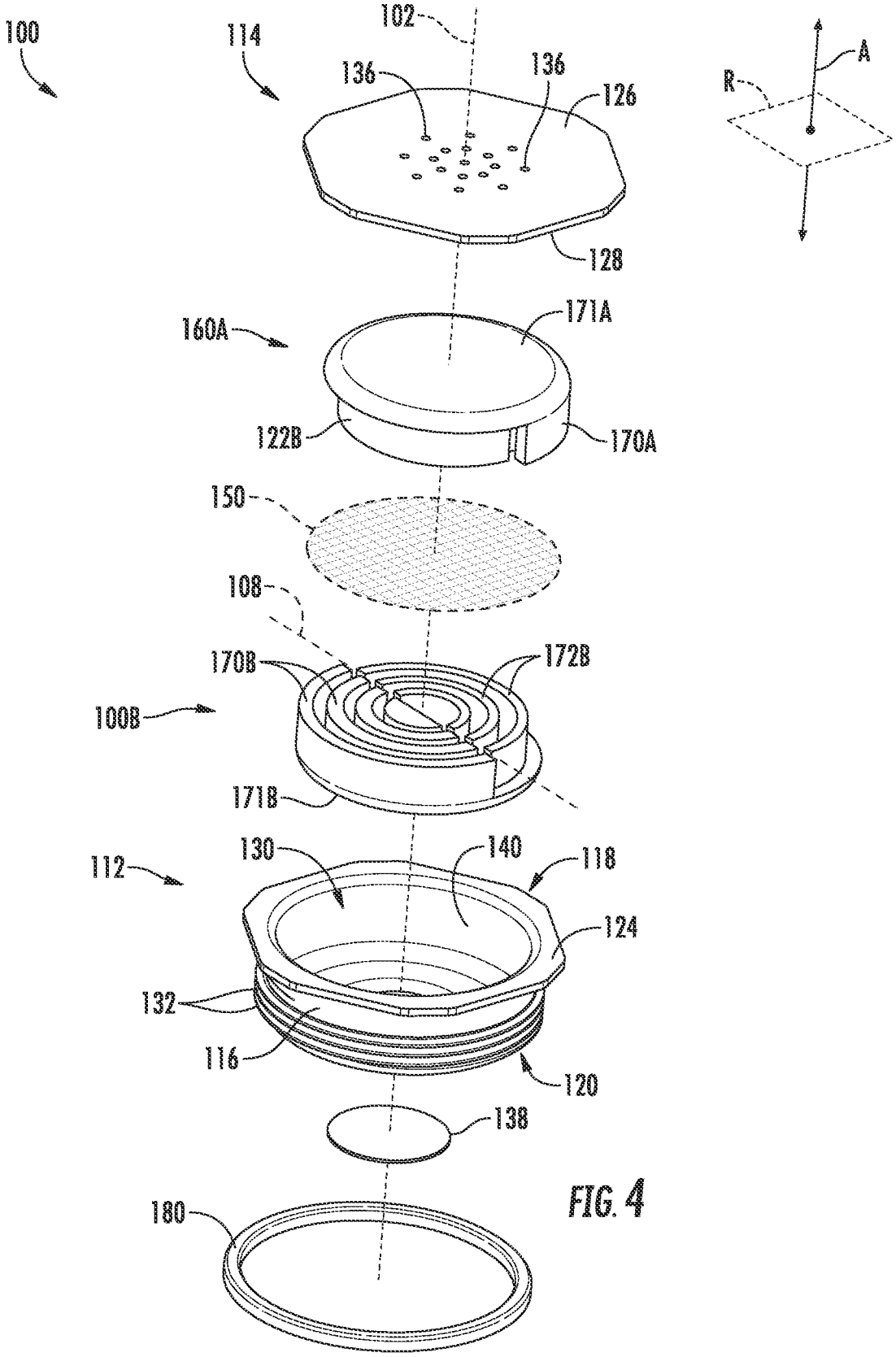
FIG. 4 illustrates an exploded view of the CAPS assembly shown in FIGS. 2 and 3 in accordance with aspects of the present subject matter.

Referring now to FIGS. 2-5, various views of one embodiment of the compact augmented permeation system (CAPS) assembly 100 shown in FIG. 1 are illustrated in accordance with aspects of the present subject matter. Specifically, FIG. 2 illustrates a first perspective view (e.g., a top perspective view) of the CAPS assembly 100, and FIG. 3 illustrates a second perspective view (e.g., a bottom perspective view) of the CAPS assembly 100. Additionally, FIG. 4 illustrates an exploded view of the CAPS assembly 100 shown in FIGS. 1-3, and FIG. 5 illustrates a cross-sectional view of the CAPS assembly 100 shown in FIG. 1 taken about line IV-IV, particularly illustrating the CAPS assembly 100 as installed relative to the adjacent storage container 50.

Figure 5:
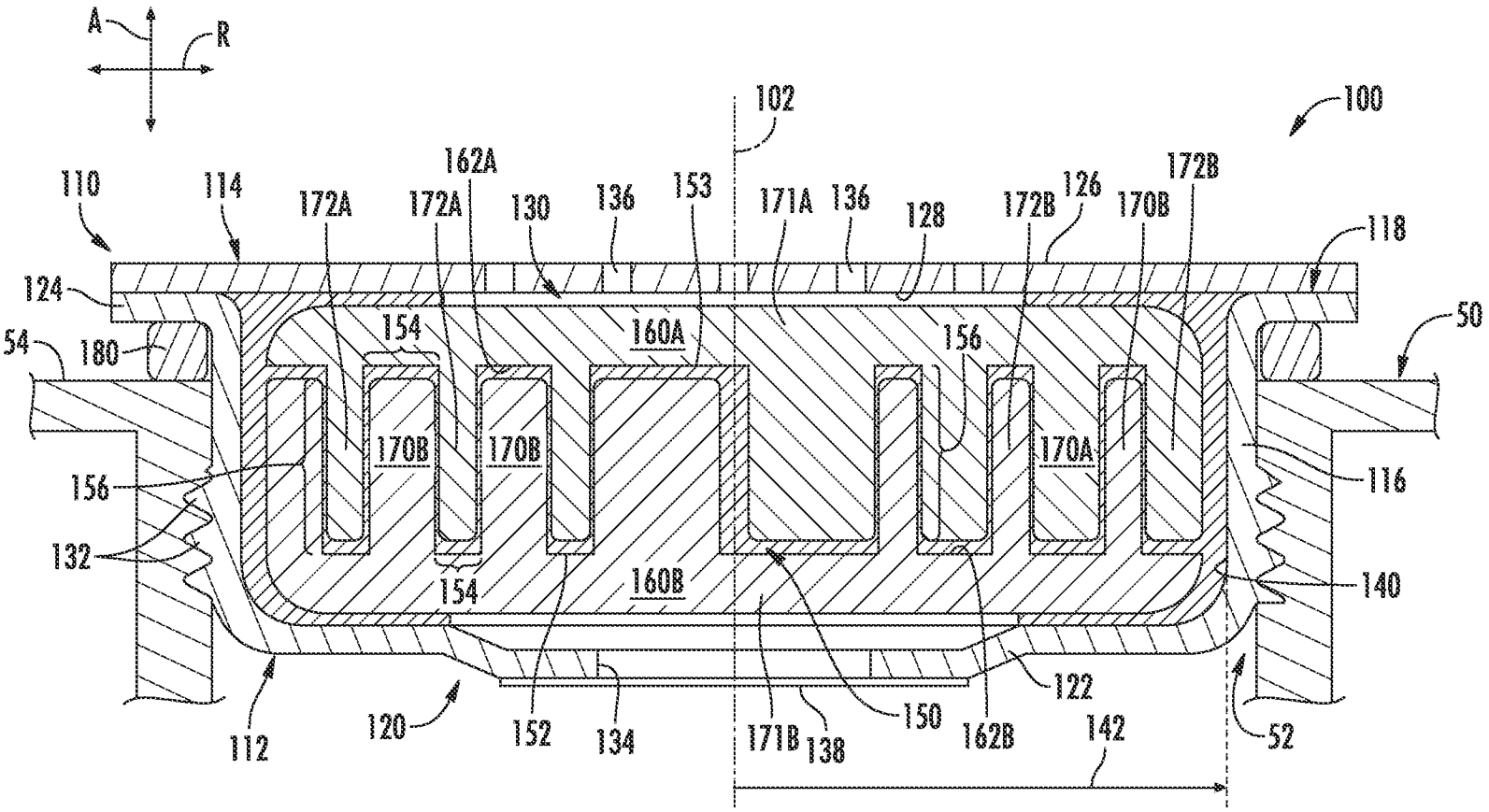
FIG. 5 illustrates a cross-sectional view of the CAPS assembly shown in FIG. 1 taken about line V-V in accordance with aspects of the present subject matter.

It should be appreciated that, for purposes of reference, the CAPS assembly 100 (and its various components) will generally be described in relation to specific directional references, namely an axial direction (indicated by arrow A in FIGS. 4 and 5) and a radial direction (indicated schematically by plane R in FIG. 4 and by arrow R in FIG. 5). In general, the axial direction A is defined as a direction extending parallel to a central longitudinal axis 102 (FIGS. 4 and 5) of the CAPS assembly 100. Additionally, the radial direction R is defined as any direction extending from the central longitudinal axis 102 outwardly along a plane oriented perpendicular to the central longitudinal axis 102.

As shown, the CAPS assembly 100 includes an outer housing 110 and one or more components configured to be supported within and/or enclosed within the housing 110. For instance, in the illustrated embodiment, the CAPS assembly 100 includes a gas-permeable membrane 150 (shown schematically in FIG. 4, and in its assembled or formed state in FIG. 5) positioned within the outer housing 110. As will be described in greater detail below, gases contained within a storage container relative to which the CAPS assembly 100 is installed (e.g., container 50 shown in FIG. 1) may be allowed to enter the housing 110 along one of its sides (e.g., the side facing the interior of the container), permeate through the membrane 150, and exit the housing 110 along one of its other sides (e.g., the opposed side facing outwardly from the container), thereby allowing for such gases to be expelled from the container without requiring any venting. In allowing for such permeation, the CAPS assembly 100 may prevent any liquids, solids, and aerosols from passing therethrough, thereby ensuring that no unwanted materials are expelled from the associated container.

In several embodiments, the outer housing 110 of the CAPS assembly 100 may be configured as a multipiece assembly. For instance, as shown in FIGS. 2-5, the housing 110 is configured as a two-piece construction including both a lower housing portion 112 and an upper housing portion 114. As particularly shown in FIGS. 4 and 5, the lower housing portion 112 generally includes an outer housing wall 116 (e.g., a cylindrical wall) extending axially between a top side 118 and a bottom side 120 of the lower housing portion 112. Additionally, the lower housing portion 114 includes a bottom wall 122 (FIGS. 3 and 5) extending radially inwardly relative to the outer housing wall 116 across the bottom side 120 of the lower housing portion 112 such that the bottom wall 122 generally defines a bottom or inner face of the CAPS assembly 100. Moreover, as particularly shown in FIGS. 4 and 5, the lower housing portion 112 further includes an upper mounting flange 124 extending radially outwardly from the outer housing wall 116 along the top side 118 of the lower housing portion 112 such that the mounting flange 124 defines a mounting surface or platform for coupling the upper housing portion 114 to the lower housing position 112.

In several embodiments, the upper housing portion 114 of the housing 110 may generally have a flat or planar configuration. For instance, as particularly shown in FIGS. 4 and 5, the upper housing portion 114 may be configured as a flat plate defining a top side 126 and a bottom side 128, with the top side 126 of the upper housing portion 114 generally defining a top or outer face of the CAPS assembly 100. In several embodiments, the upper housing portion 114 may be configured to function as a cap or cover for the lower housing position 112. For instance, as shown in FIG. 5, the upper housing portion 114 may be configured to be supported on top of the lower housing portion 112 via the mounting flange 124 such that the upper housing portion 114 extends radially across the top side 118 of the lower housing portion 112. As a result, with the upper housing portion 114 installed relative to the lower housing portion 112, the assembled housing 110 may generally define an interior cavity 130 (FIG. 5) within which the internal components of the CAPS assembly 100 (e.g., the membrane 150 and any optional support structure) may be housed. For instance, the interior cavity 130 may extend axially between the upper housing portion 114 and the bottom wall 122 of the lower housing portion 112, and radially between the longitudinal central axis 102 and an inner surface 140 of the lower housing portion 112.

It should be appreciated that the upper housing portion 114 may be configured to be coupled to the lower housing portion 112 in any suitable manner. For instance, in one embodiment, the upper housing portion 114 may be welded or riveted to the lower housing portion 112. Specifically, in one embodiment, the radially outer sections of the upper housing portion 114 that overlap the mounting flange 124 of the lower housing portion 112 may be welded or riveted thereto to couple the housing portions 112, 114 together. Additionally, in one embodiment, the interface provided between the bottom side 128 of the upper housing portion 114 and the mounting flange 124 of the lower housing portion 112 may be sealed. For instance, the connection method used to couple the housing portions 112, 114 together may provide a seal at the interface defined between such housing portions 112, 114 or a separate seal or sealing material may be provided between the bottom side 128 of the upper housing portion 114 and the mounting flange 124 (e.g., as will be described below with reference to FIGS. 9-11).

As described above with reference to FIG. 1, the CAPS assembly 100 may be configured to be selectively or removably coupled to an associated storage container 50. Thus, in several embodiments, the outer housing 110 of the CAPS assembly 100 may include or incorporate features for allowing the assembly 100 to be selectively or removably coupled to the storage container 50. For instance, as shown in the illustrated embodiment, the cylindrical wall 116 of the lower housing portion 112 is threaded such that a plurality of threads 132 are defined around the outer perimeter of the housing 110. As such, the illustrated embodiment of the CAPS assembly 100 can be threaded into a corresponding threaded opening 52 (FIG. 5) of the associated container 50 to allow the CAPS assembly 100 to be installed relative to the container 50.

Additionally, the housing 110 may also be configured to define one or more inlets for allowing gases to flow into the interior cavity 130 of the housing 110 and one or more outlets for allowing the gases contained within the cavity 130 to flow out of the housing 110. For instance, as shown in FIG. 5 and as represented by the dashed circle in FIG. 3, a single inlet aperture 134 (e.g., a larger, centralized aperture) is defined through the bottom wall 122 of the lower housing portion 112 that functions as the gas inlet for the CAPS assembly 100 while a plurality of outlet apertures 136 (e.g., smaller weep holes) are defined through the upper housing portion 114 that function as the gas outlet for the CAPS assembly 100. Alternatively, both housing portions 112, 114 may define a single inlet/outlet aperture 134, 136 or a plurality of inlet/outlet apertures 134, 136 for providing a gas inlet/outlet for the CAPS assembly 100.

Moreover, in certain embodiments, the CAPS assembly 100 may optionally include a porous cover for the aperture(s) 134, 136 forming the gas inlet and/or gas outlet. For instance, as shown in the illustrated embodiment, the CAPS assembly 100 includes a lower inlet cover 138 formed from a porous or mesh material (e.g., a steel mesh) that is configured to be installed over the inlet aperture 134 defined by the lower housing portion 112. In such an embodiment, the cover 138 may be configured to be coupled to the lower housing portion 112 using any suitable means, such as by welding the cover 138 to the bottom wall 122 of the lower housing portion 112 around the outer perimeter of the inlet aperture 134. The cover 138 may be particularly advantageous, for example, when the membrane 150 is formed via an injection or infusion process, as will be described below.

As indicated above, the CAPS assembly 100 includes a gas-permeable membrane 150 positioned within the interior cavity 130 of the housing 110. In several embodiments, the membrane 150 may correspond to a continuous, solid gas-permeable membrane that is configured to define or form a sealed system boundary across the interior of the housing 110. Specifically, the membrane 150 may be configured to extend across the interior cavity 130 of the housing 110 and at least partially seal against an inner surface of the housing 110 (e.g., the inner surface 140 of the lower housing portion 112) such that gases entering the housing 110 via the gas inlet (e.g., via the inlet aperture 134) must permeate through the membrane 150 prior to such gases being expelled from the housing 110 via the gas outlet (e.g., via the outlet apertures 136). As a result, the membrane 150 may function to allow gases to permeate across the system boundary while preventing solids, liquids, and aerosols from passing therethrough.

It should be appreciated that the membrane 150 may generally be formed from any suitable gas-permeable material that can also function to block the passage of solids, liquids, and aerosols. For instance, in several embodiments, the membrane 150 may be formed from a silicone-based material, such as room-temperature-vulcanizing (RTV) silicone material. However, in other embodiments, the membrane may be formed from any other suitable materials, such as fluorosilicone or ethylene propylene.

Referring still to FIGS. 2-5, in several embodiments, the CAPS assembly 100 may also include one or more support structures 160 that are configured to support the membrane 150 within the interior of the housing 110. For instance, in certain embodiments, the membrane 150 may correspond to a flexible or substantially flexible membrane that requires additional structural support to allow the membrane 150 to be maintained in a desired shape/geometry and/or at a desired location within the interior of the housing 110. In such embodiments, the support structure(s) 160 may function to provide the required level of support within the interior of the housing 110. However, in embodiments in which the membrane 150 corresponds to a rigid or self-supporting component, the support structure(s) 160 may be unnecessary.

As shown in the illustrated embodiment, the CAPS assembly 100 includes both an upper support structure 160A and a lower support structure 160B. In such an embodiment, the membrane 150 may be configured to be supported within the housing 110 between the upper and lower support structures 160A, 160B. For instance, as particularly shown in FIG. 5, the membrane 150 is at least partially sandwiched between the upper and lower support structures 160A, 160B. However, in other embodiments, the CAPS assembly 100 may only include a single support structure within the interior of the housing 110 to support the membrane 150, such as by only including a lower support structure or an upper support structure.

It should be appreciated that the support structure(s) 160 may generally be formed from any suitable material that permits gases to pass therethrough. For instance, in several embodiments, the support structure(s) 160 may be formed from a porous metal material, such as sintered metal, metal foam, or any other suitable porous metal material. However, in other embodiments, the support structure(s) 160 may be formed from any other suitable material, such as a porous non-metal material. It should also be appreciated that the support structure(s) 160 may, in certain embodiments, be secured in place within the housing 110* using any suitable attachment or connection means. For instance, in one embodiment, the support structure(s) 160 may be welded or adhered to adjacent portions of the housing 110.

Figure 12:
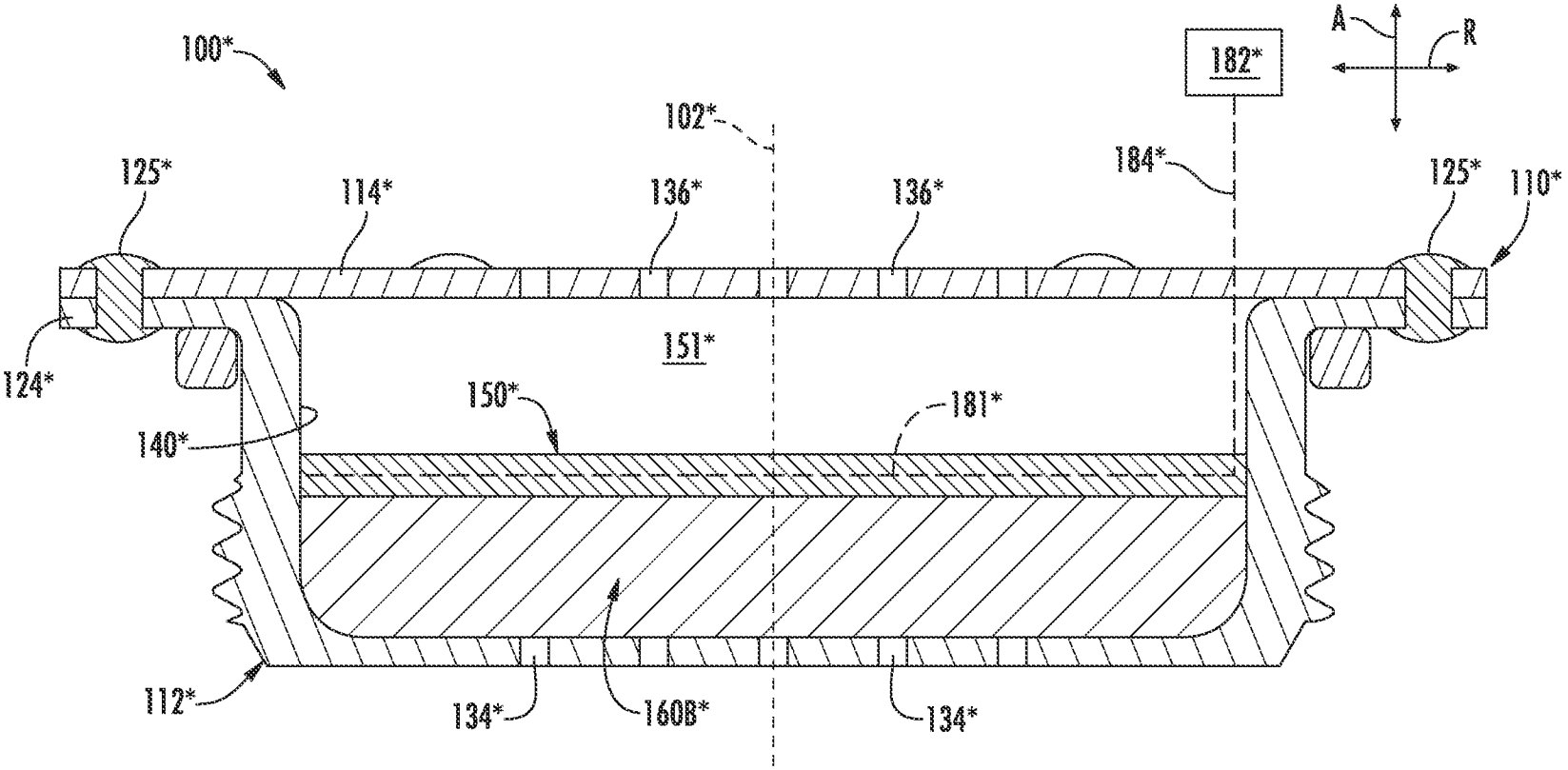
FIG. 12 illustrates a cross-sectional view of a further embodiment of a CAPS assembly in accordance with aspects of the present subject matter.

In accordance with aspects of the present subject matter, the membrane 150 may be adapted to have a non-planar configuration within the housing 110 so that the surface area of the membrane 150 is increased relative to an otherwise planar membrane (e.g., a flat disk-like or plate-like membrane, such as the membrane shown in FIG. 12), thereby allowing for the permeation rate of the CAPS assembly 100 to be similarly increased relative to the permeation rate that would otherwise be achieved using a planar membrane. Specifically, in several embodiments, the membrane 150 may be configured such that an inner surface 152 (FIG. 5) of the membrane 150 (i.e., the continuous surface of the membrane 150 that generally faces towards the lower support structure 160B and is the surface of the membrane 150 that is first encountered by any gases permeating through the membrane 150 at any location along the radial/axial profile of the membrane 150) has a non-planar configuration, thereby allowing for such membrane surface 152 to define an increased surface area. For instance, in one embodiment, the inner surface 152 of the membrane 150 may define a surface area that is greater than a radial cross-sectional area of the interior cavity 130 defined by the housing 110 (e.g., the cross-sectional area of the cavity 130 as measured along a two-dimensional plane extending perpendicular to the central axis 102 of the CAPS 100). For instance, in the illustrated embodiment, the radial cross-sectional area of the interior cavity 130 would generally be calculated as function of an inner radius 142 (FIG. 5) of the lower housing portion 112 defined relative to the central axis 102 of the CAPS assembly 100 (e.g., $A=\pi*r^2$, where "r" is the inner radius 142 of the lower housing portion 112). Thus, in other words, the membrane 150 may be configured such that the surface area of the inner surface 152 of the membrane 150 is greater than the surface area that would be defined by a planar membrane that simply extends radially across the interior cavity 130 between the central axis 102 and the inner surface 140 of the housing 110.

To achieve such an increased surface area, the membrane 150 may be configured to a define a three-dimensional geometry within the housing 110 (e.g., a complex three-dimensional geometry) so that the inner surface 152 of the membrane 150 extends in or is otherwise oriented in both the radial direction R and the axial direction A of the CAPS assembly 100. For instance, as particularly shown in FIG. 5, the membrane 150 extends across the interior of the housing 110 in both the radial direction R (e.g., along sections 154 and similar non-labeled radially oriented sections of the membrane 150 shown in FIG. 5) and the axial direction A (e.g., along sections 156 and similar non-labeled axially oriented sections of the membrane 150 shown in FIG. 5). Specifically, in the illustrated embodiment, as the membrane 150 extends radially outwardly from the central axis 102 of the CAPS assembly 100 towards the inner surface 140 of the lower housing portion 112, the inner surface 152 of the membrane 150 alternates between radially-oriented sections 154 and axially-oriented sections 156, with the axially-oriented sections 156 allowing additional surface area to be provided to the membrane 150 relative to an entirely radially-oriented planar membrane.

It should be appreciated that, in embodiments in which the membrane 150 is a self-supporting component of the CAPS assembly 100, the desired three-dimensional geometry of the membrane 150 may be defined and maintained by the membrane 150 itself. Alternatively, the support structure(s) 160 may be configured to support the membrane 150 within the housing 110 such that it maintains the desired three-dimensional geometry. For instance, in the illustrated embodiment, the upper and lower support structures 160A, 160B both define complex three-dimensional geometries. Specifically, the upper and lower support structures 160A, 160B have non-planar configurations including mating or complementary features such that, when the support structures 160A, 160B are assembled relative to each other, the interface defined between a lower support surface 162B (FIG. 5) of the lower support structure 160B (i.e., the surface that contacts and directly supports the inner surface 152 of the membrane 150) and an upper support surface 162A (FIG. 5) of the upper support structure 160A (i.e., the surface that contacts an opposed outer surface 153 (FIG. 5) of the membrane 150) generally defines the desired profile/geometry for the membrane 150. Specifically, as shown in FIG. 5, both the support surface 162B of the lower support structure 160B and the support surface 162A of the upper support structure 160A extend across the interior of the housing 110 in both the radial direction R (e.g., along sections 154 and similar non-labeled radially oriented sections shown in FIG. 5) and the axial direction A (e.g., along sections 156 and similar non-labeled axially oriented sections shown in FIG. 5). As a result, when the membrane 150 is positioned or formed between the upper and lower support structures 160A, 160B such that the membrane 150 occupies or fills the gap defined between the adjacent support surfaces 162A, 162B of the structures 160A, 160B, the membrane 150 will generally take on the three-dimensional geometry or non-planar configuration of the support structures 160A, 160B, thereby providing the membrane 150 with the desired amount of surface area and, thus, the desired permeation rate.

In several embodiments, the upper and lower support structures 160A, 160B may have mirrored geometries to eliminate fabrication/manufacturing costs. Specifically, in the illustrated embodiment, the upper and lower support structures 160A, 160B have the exact same configuration and are adapted such that, by flipping one of the support structures 160A, 160B over and rotating such support structure 160A, 160B 180 degrees relative to the other structure, the support structures 160A, 160B can be assembled into the nesting/mating configuration shown in FIG. 5. For instance, as particularly shown in FIG. 4, the configuration of the lower support structure 160B is split into halves along a reference dividing line 168 extending through the center of the support structure 160B. Specifically, in the illustrated embodiment, a first half of the support structure 160B positioned along a first side of the dividing line 168 includes a first set of arcuate and/or semi-circular ribs 170B extending axially from a base plate 171B of the support structure 160B, and a second half of the support structure 160B positioned along an opposed second side of the dividing line 168 includes a second set of arcuate and/or semi-circular ribs 172B extending axially from the base plate 171B of the support structure 160B, with each of the ribs 170B, 172B being spaced apart from the central axis 102 by a different radial distance than the other ribs 170B, 172B. The upper support structure 160A likewise includes first and second sets of arcuate and/or semi-circular ribs 170A, 172A extending from a base plate 171A of the support structure 170A. As a result, since the upper support structure 160A has the exact same configuration as the lower support structure 160B, the upper support structure 160A can be flipped and rotated 180 degrees relative to the lower support structure 160B (e.g., so that the upper support structure 160A has the orientation shown in FIGS. 4 and 5) to allow the support structures 160A, 160B to be assembled into the nesting/mating configuration shown in FIG. 5. Specifically, as shown in FIG. 5, the second set of ribs 172B of the lower support structure 160B are received within and extend into the radial gaps defined between the first set of ribs 170A of the upper support structure 160A, while the second set of ribs 172A of the upper support structure 160A are received within and extend into the radial gaps defined between the first set of ribs 170B of the lower support structure 160B. It should be appreciated that, in other embodiments, the support structures 160A, 160B may be configured to have non-mirrored geometries or different configurations, as desired.

It should also be appreciated that the specific geometries or configurations of the membrane 100 and support structures 160A, 160B shown in FIGS. 2-5 are simply illustrated to provide one example of suitable membrane and support structure geometries/configurations. In other embodiments, the membrane 150 and support structures 160A, 160B may be configured to define any other suitable geometries and/or may have any other suitable configurations, including various other three-dimensional geometries that provide for or result in a non-planar configuration of the membrane 150. For instance, in other embodiments, the membrane 100 and support structures 160A, 160B may define a sinusoid or checkerboard pattern or profile.

Referring still to FIGS. 2-5, as indicated above, the membrane 150 may be configured to extend across the interior cavity 130 and at least partially seal against an inner surface of the housing 110 (e.g., the inner surface 144 of the lower housing portion 112) such that gases entering the housing 110 via the gas inlet (e.g., via the inlet aperture 134) must permeate through the membrane 140 prior to such gases being expelled from the housing 110 via the gas outlet (e.g., via the outlet apertures 136). Accordingly, in addition to being supported between the support structures 160A, 160B, the membrane 150 may also be configured to extend outwardly therefrom to allow the membrane 150 to seal against the inner surface 144 of the housing 110. For instance, as particularly shown in FIG. 5, the membrane 150 not only fills or occupies the gap defined between the support structures 160A, 160B, but also fills or occupies at least a portion of the gap defined between the housing 110 and one or both of the support structures 160A, 160B, thereby providing a continuous, sealed, gas-permeable system boundary across the interior cavity 130 of the housing 110. As such, in the absence of any pressure relief features (as will be described below with reference to FIGS. 14 and 15), gases entering the housing 110 can only be directed to the gas outlet by permeating through the membrane 150 (i.e., the gases cannot flow around the membrane 150). It should be appreciated that, in the illustrated embodiment, the membrane 150 only partially fills the volume of the interior cavity 130 not otherwise occupied by the support structures 160. However, in other embodiments, the membrane 150 may completely fill the volume of the interior cavity 130 that is not otherwise occupied by the support structures 160.

It should also be appreciated that, in one embodiment, the membrane 150 may be configured as a prefabricated component of the CAPS 100. In other embodiments, the membrane 150 may be formed onto or relative to one or more other components of the CAPS assembly 100 during the assembly process thereof or at any other stage in the manufacturing process. For instance, membrane material may be applied to or coated on one or more of the support structures 160A, 160B and/or the inner surfaces of the housing 110 as a liquid and allowed to cure to form the membrane. As an example, in the illustrated embodiment, a liquid membrane material (e.g., silicone RTV) may be applied onto the lower support structure 160B (e.g., by dipping the structure 160B in the liquid membrane material or by coating the structure 160B with a layer of the liquid membrane material) prior to or after installation of the support structure 160B within the lower housing portion 112. The upper support structure 160A may then be installed relative to the lower support structure 160B such that the support structures 160A, 160B take on the nesting/mating configuration shown in FIG. 5 in which case the liquid membrane material will spread out and fill the gap defined between the support structures 160A, 160B as the upper support structure 160A is pressed downwardly into the lower support structure 160B. Additionally, during such process, excess liquid membrane material will be squeezed out from between the support structures 160A, 160B and flow into the gap defined between the support structures 160A, 160B and the housing 110, thereby allowing the membrane material to seal against the housing 110. The liquid membrane material may then be allowed to cure to form the final membrane structure. In another embodiment, the support structures 160A, 160B may be pre-assembled relative to each other within the housing 110. Thereafter, a liquid membrane material may be injected into, or vacuum infused throughout the housing 110 (and onto and/or between the support structures 160A, 160B) and allowed to cure to form the final membrane structure.

Moreover, in several embodiments, the CAPS assembly 100 may also incorporate an outer gasket or sealing device 180 configured to provide a seal between the housing 110 and an adjacent outer surface of the associated storage container. For instance, as shown in FIG. 5, the outer seal 180 may be configured to be positioned around the lower housing portion 112 such that, when the CAPS assembly 100 is threaded into the associated threaded opening 52 of the container 50, the seal 180 is compressed between the mounting flange 124 of the lower housing portion 112 and the adjacent outer surface 54 of the storage container 50.

Figure 6:
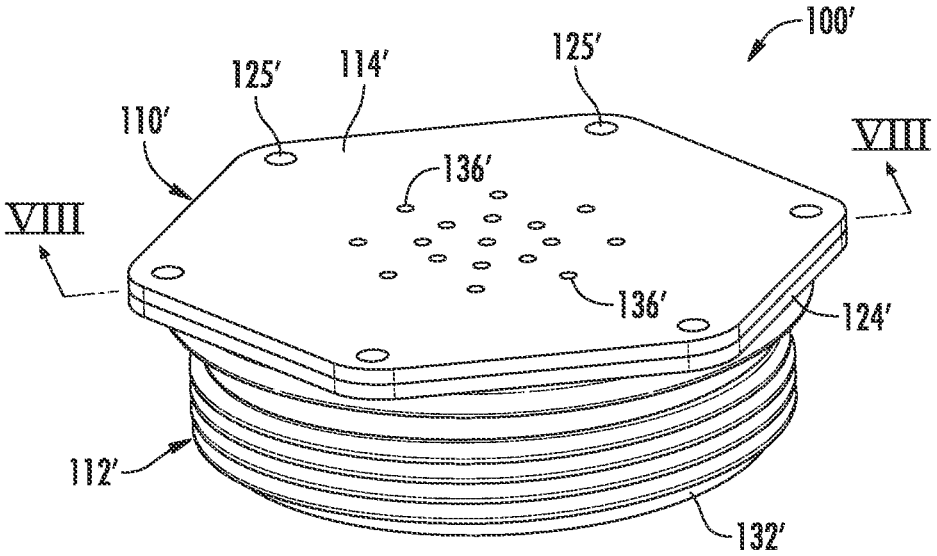
FIG. 6 illustrates a perspective view of another embodiment of a CAPS assembly in accordance with aspects of the present subject matter.
Figure 7:
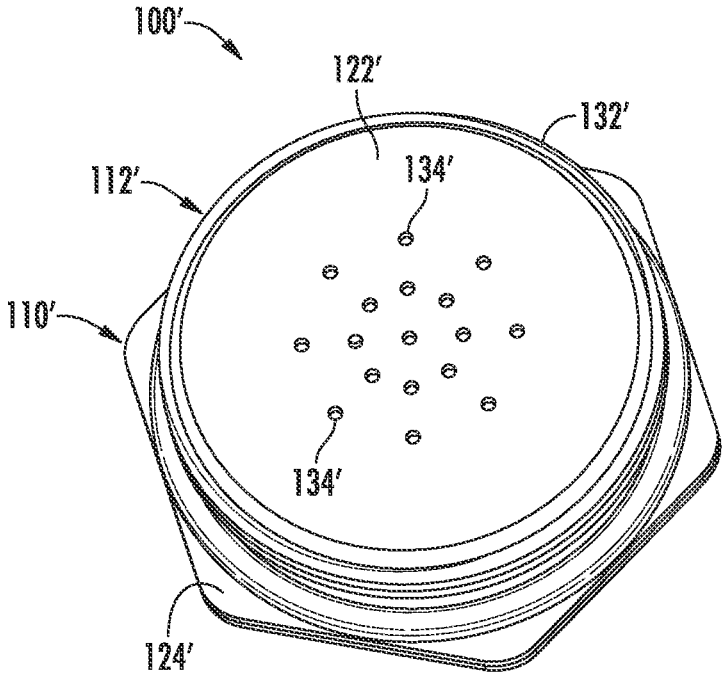
FIG. 7 illustrates another perspective view of the CAPS assembly shown in FIG. 6 in accordance with aspects of the present subject matter.
Figure 8:
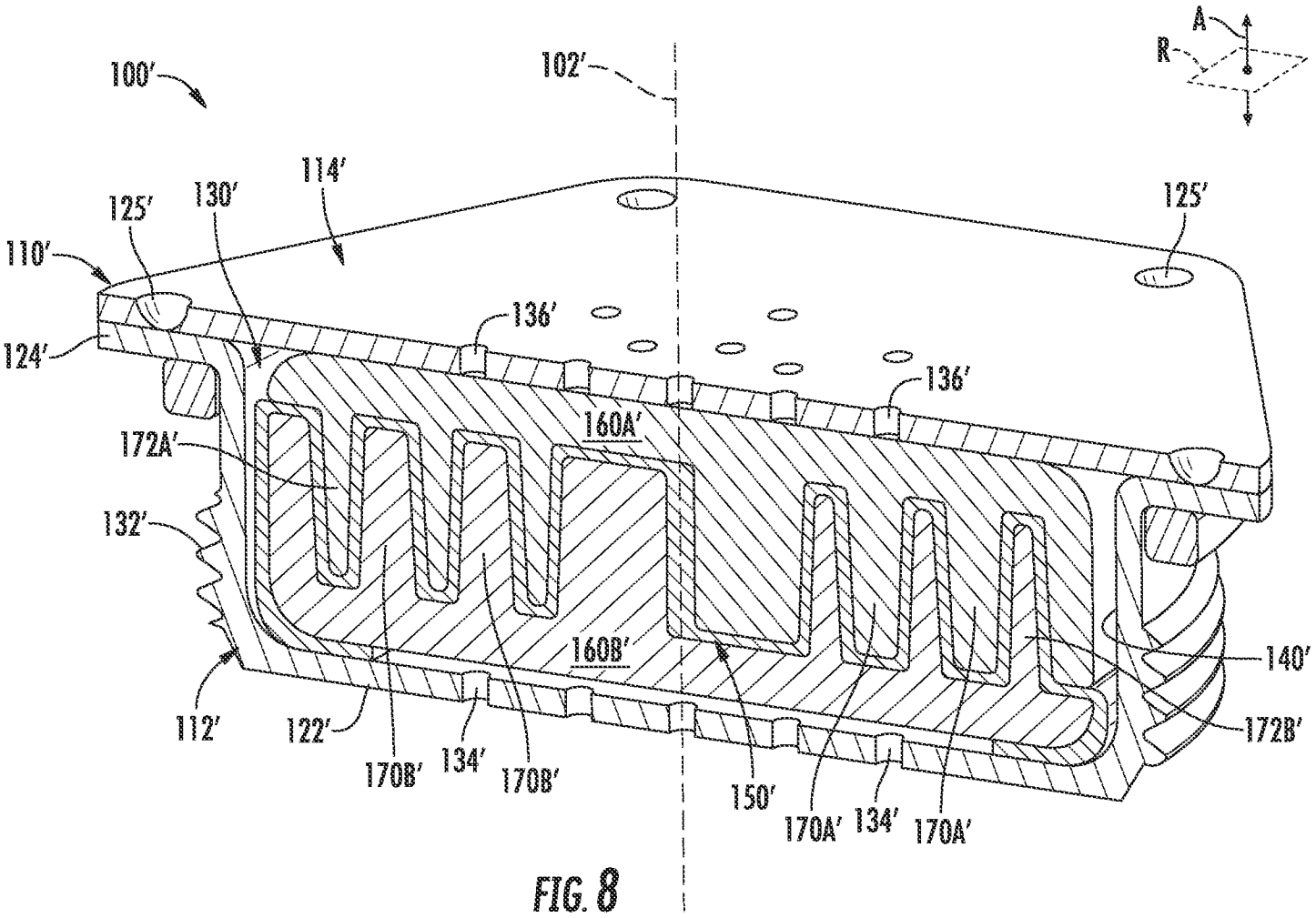
FIG. 8 illustrates a cross-sectional view of the CAPS assembly shown in FIG. 6 taken about line VIII-VIII in accordance with aspects of the present subject matter.

Referring now to FIGS. 6-8, various views of another embodiment of a CAPS assembly 100' are illustrated in accordance with aspects of the present subject matter. Specifically, FIG. 6 illustrates a first perspective view (e.g., a top perspective view) of the CAPS assembly 100', and FIG. 7 illustrates a second perspective view (e.g., a bottom perspective view) of the CAPS assembly 100'. Additionally, FIG. 8 illustrates a cross-sectional view of the CAPS assembly 100' shown in FIG. 6 taken about line VIII-VIII. In general, the CAPS assembly 100' shown in FIGS. 6-8 and its associated components, features, and/or structures are configured similar to the CAPS assembly 100 described above with reference to FIGS. 1-5 and its associated components, features, and/or structures. As such, the components, features, and/or structures of the CAPS assembly 100' that are the same or similar to corresponding components, features, and/or structures of the CAPS assembly 100 described above will be designated by the same reference character with an apostrophe (') added. Additionally, when a given component, feature, and/or structure of the CAPS assembly 100' is configured to generally perform the same function as the corresponding component, feature, and/or structure of the CAPS assembly 100 described above, a less detailed description of such component/feature/structure will be provided below for the sake of brevity.

As shown in FIGS. 6-8, similar to the CAPS assembly 100' described above, the CAPS assembly 100' includes a two-piece housing 110' having both a lower housing portion 112' and an upper housing portion 114', with the upper housing portion 114' configured to be coupled to the lower housing portion 112' such that the housing 110' defines an interior cavity 130' (FIG. 8) within which the internal components of the assembly 100' can be housed. For instance, in the illustrated embodiment, the upper housing portion 114' has been tack-welded to the mounting flange 124' of the lower housing portion 112' (e.g., via a plurality of tack welds 125'). Additionally, as shown in FIGS. 6-8, the housing 110' is configured to define a gas inlet (e.g., via one or more inlet apertures 134') and a gas outlet (e.g., via one or more outlet apertures 136') for allowing gas to enter and exit the housing 110', respectively. However, unlike the embodiment described above in which the lower housing portion 134 includes a single inlet aperture, the lower housing portion 112' includes a plurality of inlet apertures 134' defined through the bottom wall 122' of the lower housing portion 112'.

Moreover, as particularly shown in FIG. 8, similar to the CAPS assembly 100' described above, the CAPS assembly 100' also includes a gas-permeable membrane 150' and one or more support structures 160' (e.g., an upper support structure 160A' and a lower support structure 160B') configured to be positioned within the housing 110', with the membrane 150' being supported between the support structures 160A, 160B relative to the housing 110'. In general, the membrane 150' may be configured the same as or similar to the membrane 150 described above. For instance, the membrane 150' may be configured to extend across the interior cavity 130' of the housing 110' and seal against portions of the inner surface 140' of the housing 110' such that the membrane 150' defines a sealed system boundary across the interior cavity 130'. As a result, gas received within the interior cavity 130' via the gas inlet must permeate through the gas-permeable membrane 150' before being expelled from the interior cavity 130' via the gas outlet. Additionally, the membrane 150 has a non-planar configuration within the housing 110', thereby allowing the membrane 150' to define an increased surface area relative to an otherwise planar membrane. For instance, in the illustrated embodiment, the membrane is oriented in both the axial direction A and the radial direction R as it extends across the interior cavity 130' to create the sealed system boundary.

Referring still to FIGS. 6-8, the upper and lower support structures 160A', 160B' are generally configured similar to the support structures 160A, 160B described above. For instance, the upper and lower support structures 160A', 160B' define mating, complex geometries such that, when assembled together, the membrane 150' is supported directly between the support structures 160A', 160B' in the desired non-planar configuration. Specifically, in the illustrated embodiment, the support structures 160A', 160B define mirrored geometries including first and second sets of radially offset ribs 170A', 170B', 172A', 172B' that nest relative to one another in assembled form. However, unlike the radially offset ribs 170A, 170B, 172A, 172B described above, at least a portion of the ribs 170A', 170B', 172A', 172B' shown in FIG. 8 taper in the axial direction as they extend outwardly from their respective support structure 160A', 160B' towards the opposed support structure 160A', 160B'.

Figure 9:
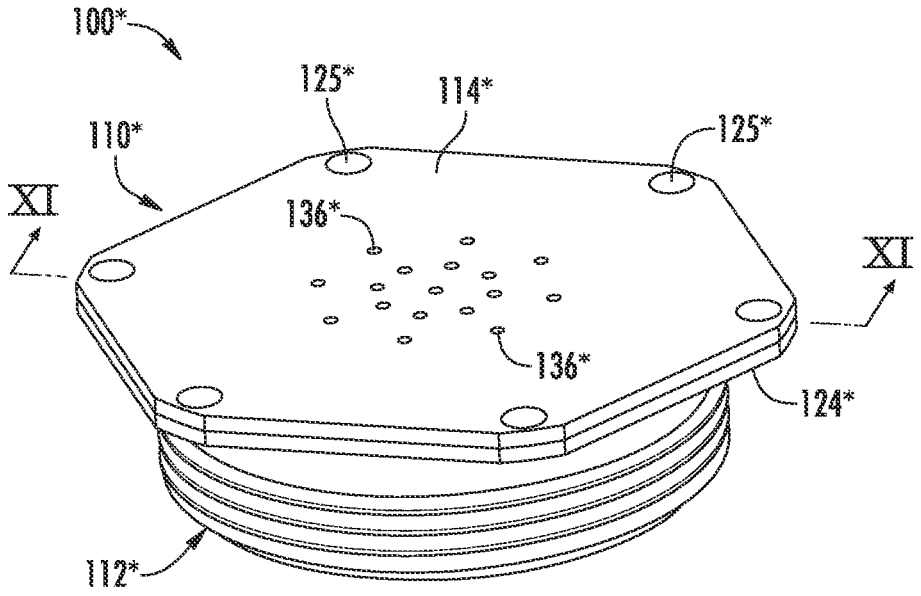
FIG. 9 illustrates a perspective view of yet another embodiment of a CAPS assembly in accordance with aspects of the present subject matter.
Figure 10:
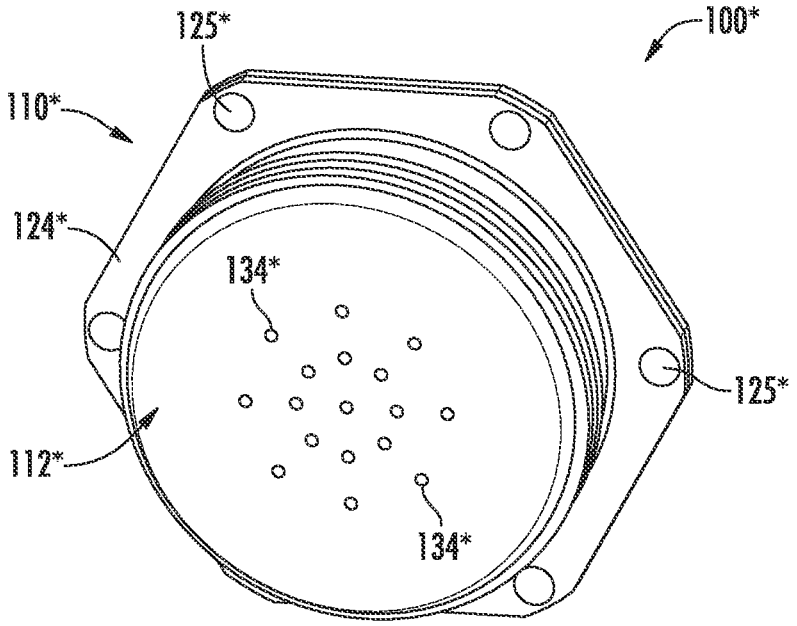
FIG. 10 illustrates another perspective view of the CAPS assembly shown in FIG. 9 in accordance with aspects of the present subject matter.
Figure 11:
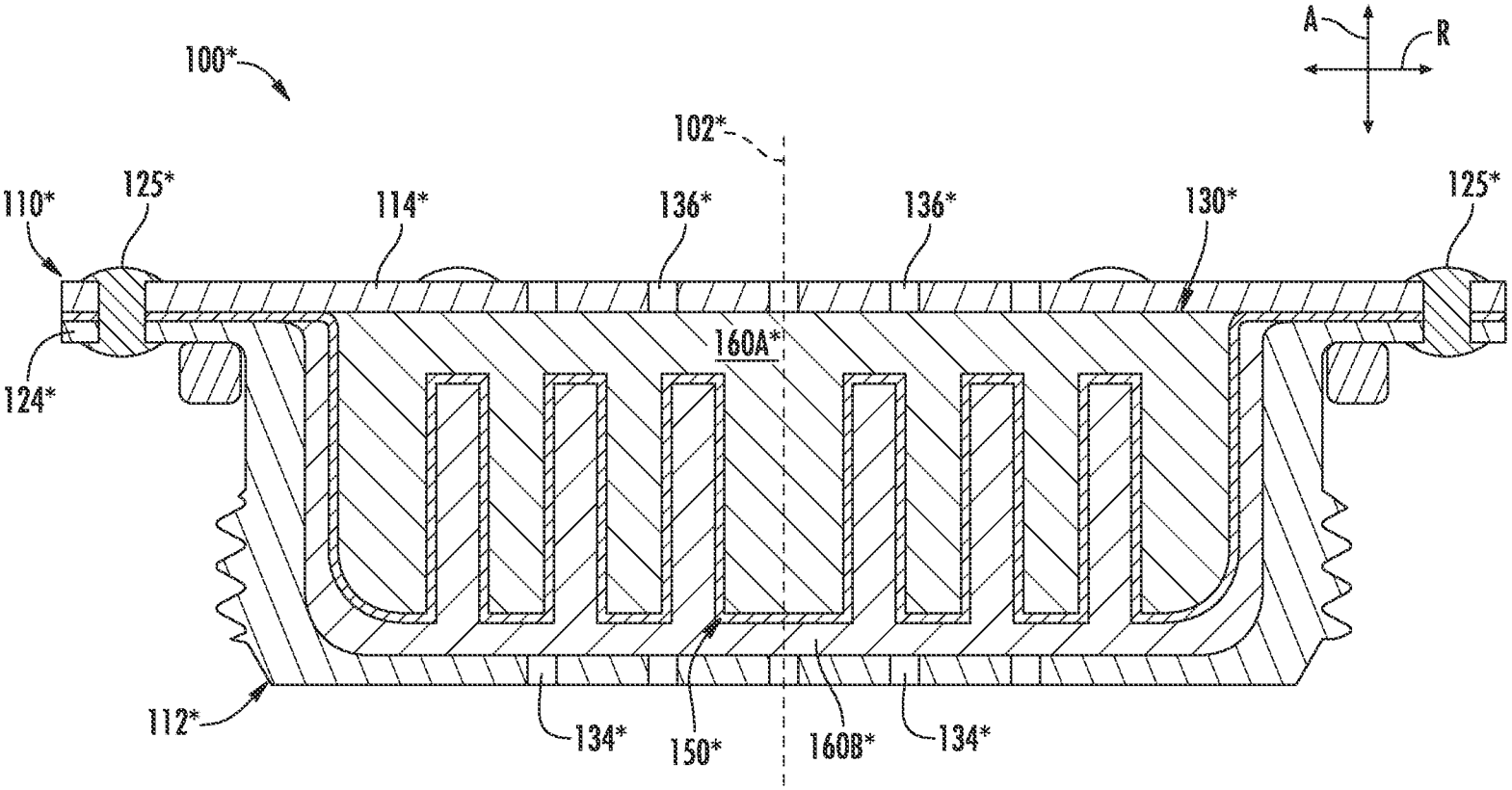
FIG. 11 illustrates a cross-sectional view of the CAPS assembly shown in FIG. 9 taken about line XI-XI in accordance with aspects of the present subject matter.

Referring now to FIGS. 9-11, various views of yet another embodiment of a CAPS assembly 100* are illustrated in accordance with aspects of the present subject matter. Specifically, FIG. 9 illustrates a first perspective view (e.g., a top perspective view) of the CAPS assembly 100*, and FIG. 10 illustrates a second perspective view (e.g., a bottom perspective view) of the CAPS assembly 100*. Additionally, FIG. 11 illustrates a cross-sectional view of the CAPS assembly 100* shown in FIG. 9 taken about line XI-XI. In general, the CAPS assembly 100* shown in FIGS. 9-11 and its associated components, features, and/or structures are configured similar to the CAPS assemblies 100, 100' described above with reference to FIGS. 1-8 and their associated components, features, and/or structures. As such, the components, features, and/or structures of the CAPS assembly 100* that are the same or similar to corresponding components, features, and/or structures of any of the CAPS assemblies 100, 100' described above will be designated by the same reference character with an asterisk (*) added. Additionally, when a given component, feature, and/or structure of the CAPS assembly 100* is configured to generally perform the same function as the corresponding component, feature, and/or structure of any of the CAPS assemblies 100, 100' described above, a less detailed description of such component/feature/structure will be provided below for the sake of brevity.

As shown in FIGS. 9-11, similar to the assemblies 100, 100' described above, the CAPS assembly 100* includes a two-piece housing 110* having both a lower housing portion 112* and an upper housing portion 114*, with the upper housing portion 114* configured to be coupled to the lower housing portion 112* such that the housing 110* defines an interior cavity 130* (FIG. 5) within which the internal components of the assembly 100* can be housed. For instance, in the illustrated embodiment, the upper housing portion 114* has been riveted to the mounting flange 124* of the lower housing portion 112* (e.g., via a plurality of rivets 125*). Additionally, as shown in FIGS. 9-11, the housing 110* is configured to define a gas inlet (e.g., via one or more inlet apertures 134*) and a gas outlet (e.g., via one or more outlet apertures 136*) for allowing gas to enter and exit the housing 110*, respectively.

Moreover, as particularly shown in FIG. 11, similar to the assemblies 100, 100' described above, the CAPS assembly 100* also includes a gas-permeable membrane 150* and one or more support structures 160* (e.g., an upper support structure 160A* and a lower support structure 160B*) configured to be positioned within the housing 110*, with the membrane 150* being supported between the support structures 160A*, 160B* relative to the housing 110*. In general, the membrane 150* may be configured the same as or similar to the membranes 150, 150' described above. For instance, the membrane 150* may be configured to extend across the interior cavity 130* of the housing 110* and seal against one or more portions of the housing 110* such that the membrane 150* defines a sealed system boundary across the interior cavity 130*. As a result, gas received within the interior cavity 130* via the gas inlet must permeate through the gas-permeable membrane 150* before being expelled from the interior cavity 130* via the gas outlet. Additionally, the membrane 150* has a non-planar configuration within the housing 110*, thereby allowing the membrane 150* to define an increased surface area relative to an otherwise planar membrane. For instance, in the illustrated embodiment, the membrane 150* is oriented in both the axial direction A and the radial direction R as it extends across the interior cavity 130* to create the sealed system boundary.

However, unlike the embodiments of the membranes 150, 150' described above, the membrane 150* also functions to create a seal between the upper and lower housing portions 112*, 114*. Specifically, as shown in FIG. 11, the membrane 150* extends not only between the upper and lower support structures 160A*, 160B*, but also extends across the interface defined between the upper and lower housing portions 112*, 114*. In such an embodiment, the membrane 150* may be formed, for example, by initially installing the lower support structure 160B* within the lower housing portion 112*, and then by coating or applying liquid membrane material onto both the lower support structure 160B* and any additional exposed portions of the lower housing portion 112* (e.g., the mounting flange 124*). The upper support structure 160A and the upper housing portion 114* may then be installed relative to the previously assembled components, at which point the membrane material is allowed to cure to form the final membrane structure.

Referring now to FIG. 12, a cross-sectional view of another embodiment of the CAPS assembly 100* described above with reference to FIGS. 8-11 is illustrated in accordance with aspects of the present subject matter. Specifically, FIG. 12 illustrates a similar cross-sectional view of the CAPS assembly 100* as that shown in FIG. 11. As shown in FIG. 12, the housing 110* (including the associated housing portions 112*, 114*) is configured the same as that described above with reference to FIGS. 8-11 (less the membrane 150* sealing the housing portions 112*, 114* together).

Additionally, similar to the embodiment described above, the membrane 150* is configured to extend across the interior cavity 130* of the housing 110* and seal against one or more portions of the housing 110* (e.g., the inner surface 140* of the housing 110*) such that the membrane 150* defines a sealed system boundary across the interior cavity 130*. As a result, gas received within the interior cavity 130* via the gas inlet must permeate through the gas-permeable membrane 150* before being expelled from the interior cavity 130* via the gas outlet. However, unlike the embodiment described above, the membrane 150* has a planar configuration within the housing 110*. Specifically, as shown in FIG. 12, the membrane 150* has a disk-like or plate configuration and is generally oriented in the radial direction R as it extends across the interior cavity 130* to create the sealed system boundary.

Moreover, unlike the embodiment described above, the CAPS assembly 100* includes a single support structure (e.g., a lower support structure 160B*) configured to support the membrane 150* within the housing 110*. In such an embodiment, an air gap or space 151* may be defined between the membrane 150* and the upper housing portion 114*. Alternatively, the CAPS assembly 100* may be configured to include an upper support structure similar to the embodiments described above.

Additionally, as shown in the illustrated embodiment, the CAPS assembly 100* includes heat-generating features that can be used to increase the temperature of the membrane 150* and, thus, increase the permeation rate of the membrane 150* (particularly at low gas temperatures). In general, the CAPS assembly 100* may be configured to include any suitable heat-generating features that can function as a source of heat for the membrane 150*. For instance, in the illustrated embodiment, a wire mesh 181* has been implanted within or otherwise coupled to the membrane 150*. In such an embodiment, the wire mesh 181* may be electrically coupled to a current source 182* (e.g., via wire 184*) to allow an electrical current to be supplied to the wire mesh 181* to generate heat that increases the operating temperature of the membrane 150*. In alternative embodiments, any other suitable heat-generating features may be used to heat the membrane 150*.

Figure 13:
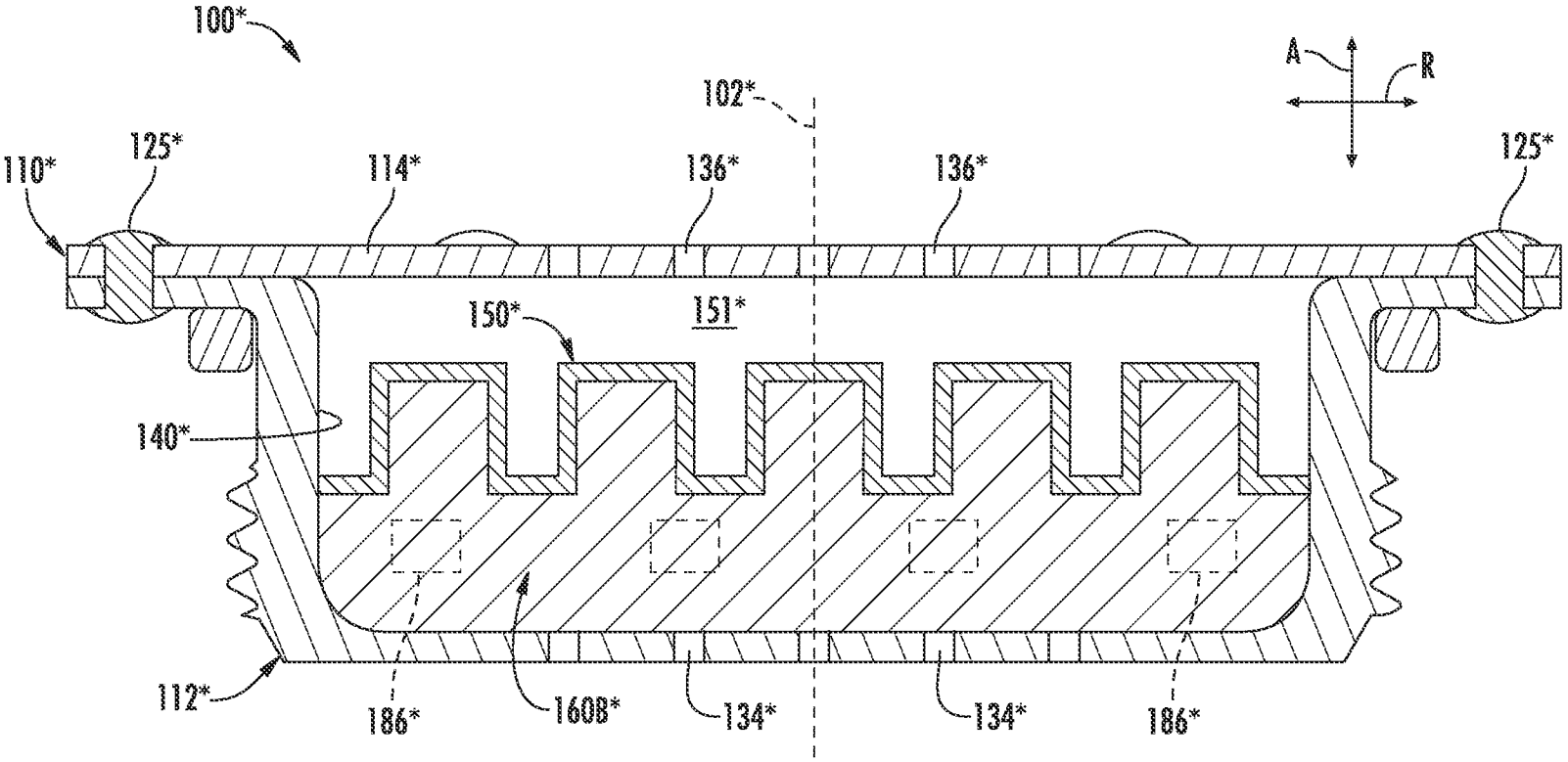
FIG. 13 illustrates a cross-sectional view of an even further embodiment of a CAPS assembly in accordance with aspects of the present subject matter.

Referring now to FIG. 13, a cross-sectional view of another embodiment of the CAPS assembly 100* described above with reference to FIGS. 8-11 is illustrated in accordance with aspects of the present subject matter. Specifically, FIG. 13 illustrates a similar cross-sectional view of the CAPS assembly 100* as that shown in FIG. 11. As shown in FIG. 13, the housing 110* (including the associated housing portions 112*, 114*) is configured the same as that described above with reference to FIGS. 8-11 (less the membrane 150* sealing the housing portions 112*, 114* together).

Additionally, similar to the embodiment described above, the membrane 150* is configured to extend across the interior cavity 130* of the housing 110* and seal against one or more portions of the housing 110* (e.g., the inner surface 140* of the housing 110*) such that the membrane 150* defines a sealed system boundary across the interior cavity 130*. As a result, gas received within the interior cavity 130* via the gas inlet must permeate through the gas-permeable membrane 150* before being expelled from the interior cavity 130* via the gas outlet. Additionally, the membrane 150* has a non-planar configuration within the housing 110*, thereby allowing the membrane 150* to define an increased surface area relative to an otherwise planar membrane. For instance, in the illustrated embodiment, the membrane 150* is oriented in both the axial direction A and the radial direction R as it extends across the interior cavity 130* to create the sealed system boundary.

Moreover, similar to the embodiment described above with reference to FIG. 12, the CAPS assembly 100* includes a single support structure (e.g., a lower support structure 160B*) configured to support the membrane 150* within the housing 110*. In such an embodiment, an air gap or space 151* may be defined between the membrane 150* and the upper housing portion 114*. Alternatively, the CAPS assembly 100* may be configured to include an upper support structure similar to the embodiments described above.

Additionally, in the illustrated embodiment, the CAPS assembly 100* includes a catalyst 186* (shown schematically in FIG. 13 as dashed boxes) incorporated therein to facilitate accelerated permeation of the gases through the system. For instance, in the illustrated embodiment, the catalyst 186* has been incorporated into the porous support material of the support structure 160B*. As a result, the catalyst 186* may react with the gases flowing through the support structure 160B* to provide for an increased permeation rate as such gases subsequently permeate through the membrane 150*.

It should be appreciated that the catalyst 186* may correspond to any suitable catalyst configured to react with the gases generated by the materials contained within the associated storage container in a manner that accelerates gas permeation through the system. For instance, suitable catalysts include, but are not limited to, platinum or ruthenium dioxide for water splitting to facilitate higher rates of permeation.

Figure 14:
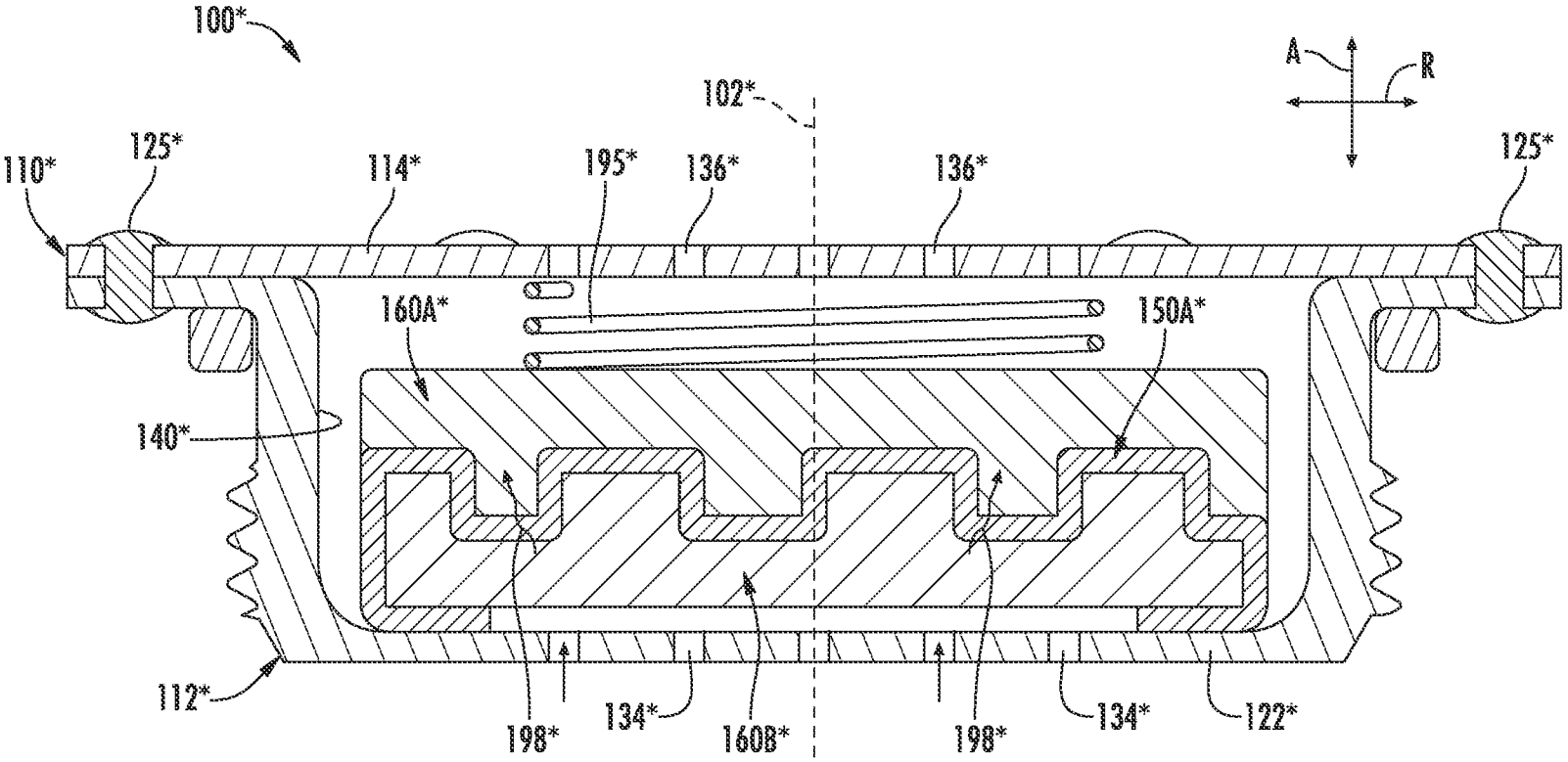
FIG. 14 illustrates a cross-sectional view of another embodiment of a CAPS assembly in accordance with aspects of the present subject matter, particularly illustrating a gas-permeable membrane of the CAPS assembly at a sealed position.
Figure 15:
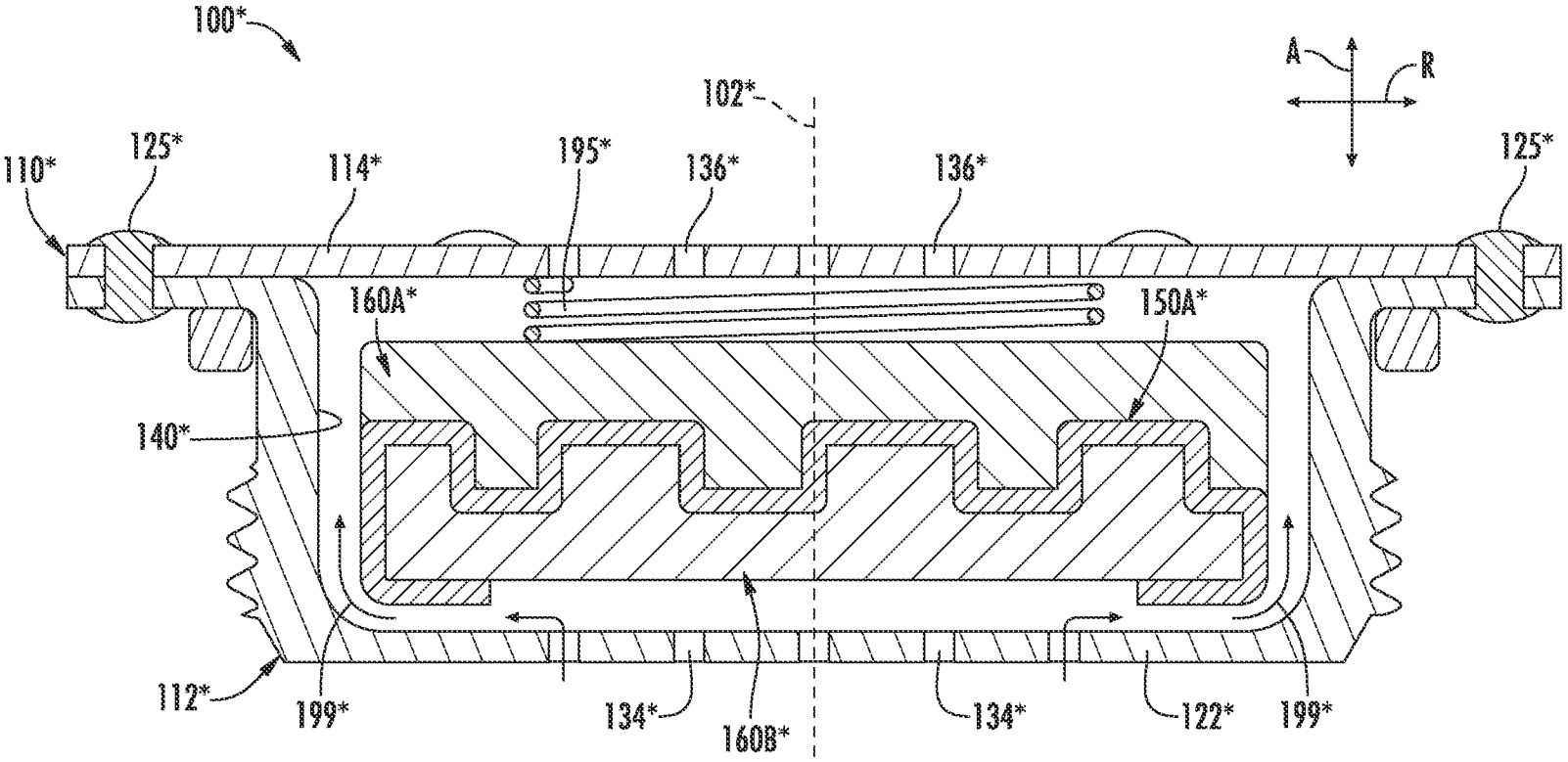
FIG. 15 illustrates another cross-sectional view of the CAPS assembly shown in FIG. 14 in accordance with aspects of the present subject matter, particularly illustrating the gas-permeable membrane of the CAPS assembly at a venting position.

Referring now to FIGS. 14 and 15, cross-sectional views of a further embodiment of the CAPS assembly 100* described above with reference to FIGS. 8-11 are illustrated in accordance with aspects of the present subject matter. Specifically, FIGS. 14 and 15 illustrate similar cross-sectional views of the CAPS assembly 100* as that shown in FIG. 11, with FIGS. 14 and 15 particularly illustrating the membrane 150* in both a sealed position (FIG. 14) and a venting position (FIG. 15) relative to the housing 110*. As shown, the housing 110* (including the associated housing portions 112*, 114*) is configured the same as that described above with reference to FIGS. 8-11 (less the membrane 150* sealing the housing portions 112*, 114* together).

Additionally, the gas-permeable membrane 150* and the support structures 160* (e.g., an upper support structure 160A* and a lower support structure 160B*) are generally configured similar to that described above with reference to FIGS. 8-11. However, unlike the embodiment described above, the CAPS assembly 100* includes one or more pressure relief features to allow gases to be vented from the system when the fluid pressure of the gases exceed a given pressure threshold. Specifically, in several embodiments, the pressure relief features may allow for the membrane 150* (and the support structures 160A*, 160B*) to move relative to the housing 110* when the gas pressure exceeds the associated pressure threshold. For instance, in the illustrated embodiment, the pressure relief features may allow for the membrane 150* (and the support structures 160A*, 160B*) to move relative to the housing 110* between a sealed position (FIG. 14), at which the membrane 150* seals against one or more portions of the housing 110* (e.g., the inner surface 140* of the housing 110*) such that the membrane 150* defines a sealed system boundary across the interior cavity 130*, and a venting position (FIG. 15), at which the membrane 150* is no longer sealed against the inner surface 140* of the housing 110* such that gases can flow between the housing 110* and the membrane 150* and, thus, bypass the membrane 150*. Therefore, when in the sealed position, gas received within the interior cavity 130* via the gas inlet must permeate through the gas-permeable membrane 150* (e.g., as indicated by arrows 198* in FIG. 14) before being expelled from the interior cavity 130* via the gas outlet. However, when in the venting position, gas received within the interior cavity 130* via the gas inlet can flow around and bypass the gas-permeable membrane 150* (e.g., as indicated by arrows 199* in FIG. 15) before being expelled from the interior cavity 130* via the gas outlet. As a result, the venting position may allow the system to "burp," or alleviate pressure, within the associated storage container during high pressure scenarios, including hypothetical accident scenarios.

As shown in FIGS. 14 and 15, to provide such pressure-relief functionality, the CAPS assembly 100* may, in one embodiment, include a biasing mechanism (e.g., a spring 195*) positioned within the housing 100* that is configured to bias the membrane 150* into the sealed position. Specifically, in the illustrated embodiment, the spring 195* is provided between the upper housing portion 114* and the upper support structure 160A* such that the spring 195* biases the upper support structure 160A* (and, thus, the membrane 150* and the lower support structure 160B*) downwardly towards the bottom wall 122* of the lower housing portion 112*, thereby pressing the membrane 150* against the inner surface 140* of the housing 110* into the sealed position. However, when the fluid pressure of the gas within the associated storage container exceeds a given pressure threshold (i.e., a pressure threshold at which the upward force provided by the gas pressure is equal to the downward biasing force provided by the spring 195*), the membrane 150* (and associated support structures 160*) are allowed to temporarily shift upwardly against the bias of the spring 195* to allow gas to flow around the membrane 150 and be expelled through the gas outlet, thereby alleviating the pressure within the associated storage container. As a result, in high pressure scenarios, the CAPS assembly 100 may allow gases to be vented in order to avoid an excess pressure condition that could otherwise, for example, result in failure of the associated storage container.

It should be appreciated that, in the illustrated embodiment, the pressure threshold at which the system is design to "burp," or vent, may generally be set by selecting an appropriate biasing force for the biasing mechanism. For instance, the spring constant of the spring 195* may be varied, as desired, to select the desired pressure threshold for the system.

It should be appreciated that, although specific components, features, and/or structures may have been described above with reference to a specific embodiment of a CAPS assembly, such components, features, and/or structures may generally be incorporated into or form part of any suitable embodiment of a CAPS assembly. For instance, the pressure-relief features described above with reference to FIGS. 14 and 15 and/or the heat-generating features described above with reference to FIG. 12 may be incorporated into any suitable embodiment of a CAPS assembly consistent with the disclosure provided herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A compact augmented permeation system (CAPS) assembly, comprising:

a housing defining an interior cavity, the housing further defining a gas inlet for receiving gas within the interior cavity and a gas outlet for expelling the gas from the interior cavity; and a solid, continuous gas-permeable membrane positioned within the housing and defining a system boundary across the interior cavity such that gas received within the interior cavity via the gas inlet permeates through the gas-permeable membrane before being expelled from the interior cavity via the gas outlet, the gas-permeable membrane including an inner surface and an opposed outer surface;

wherein the inner surface of the gas-permeable membrane has a non-planar configuration as the gas-permeable membrane extends across the interior cavity defined by the housing.

2. The CAPS assembly of claim 1, wherein the interior cavity extends within the housing in an axial direction along a longitudinal axis of the CAPS assembly and in a radial direction outwardly from the longitudinal axis, wherein the inner surface of the gas-permeable membrane is oriented in both the axial direction and the radial direction as the inner surface extends between the longitudinal axis and an inner surface of the housing.

3. The CAPS assembly of claim 1, wherein the inner surface of the gas-permeable membrane has a greater surface area than a radial cross-sectional area of the interior cavity.

4. The CAPS assembly of claim 1, further comprising at least one support structure positioned within the housing, the at least one support structure being configured to support the gas-permeable membrane in the non-planar configuration.

5. The CAPS assembly of claim 4, wherein the at least one support structure defines a support surface that contacts the gas-permeable membrane, the support surface having a non-planar configuration that matches the non-planar configuration of the gas-permeable membrane.

6. The CAPS assembly of claim 4, wherein the at least one support structure comprises a lower support structure and an upper support structure, the gas-permeable membrane being positioned between the upper and lower support structures with at least a portion of the inner surface of the gas-permeable membrane contacting the lower support structure.

7. The CAPS assembly of claim 6, wherein the upper and lower support structures define mirrored three-dimensional geometries.

8. The CAPS assembly of claim 1, wherein the gas-permeable membrane is configured to allow the gas to flow around a portion of the gas-permeable membrane without permeating therethrough when a fluid pressure of the gas exceeds a given threshold.

9. The CAPS assembly of claim 1, wherein at least a portion of the gas-permeable membrane is movable relative to the housing between a sealed position, at which the gas-permeable membrane defines the system boundary, and a venting position, at which the gas is allowed to flow around a portion of the gas-permeable membrane without permeating therethrough.

10. The CAPS assembly of claim 1, wherein at least a portion of an outer perimeter of the housing is threaded.

11. The CAPS assembly of claim 1, further comprising a heat-generating component configured to heat the gas-permeable membrane.

12. A material storage system including the CAPS assembly of claim 1, the material storage system further comprising a storage container, the CAPS assembly configured to be removably coupled to the storage container to allow the CAPS assembly to be transitioned between installed and uninstalled states relative to the storage container.

13. The material storage system of claim 12, wherein the storage container is configured to contain hazardous materials that generate the gas and wherein the storage container further defines an opening within which the CAPS assembly is configured to be installed, the CAPS assembly configured to be sealed against an adjacent surface of the storage container such that the CAPS assembly seals the opening while still allowing the gas to be expelled from the storage container via permeation through the gas-permeable membrane.

14. The material storage system of claim 13, wherein the opening comprises a threaded opening and wherein the housing is at least partially threaded such that the housing is configured to be threaded into the threaded opening to removably couple the CAPS assembly to the storage container.

15. A material storage system, comprising:

a storage container defining an opening; and a compact augmented permeation system (CAPS) assembly configured to be installed relative to the opening of the storage container, the CAPS assembly comprising:

a housing defining an interior cavity, the housing further defining a gas inlet for receiving gas within the interior cavity and a gas outlet for expelling the gas from the interior cavity; and a gas-permeable membrane positioned within the housing and defining a system boundary across the interior cavity such that gas received within the interior cavity via the gas inlet permeates through the gas-permeable membrane before being expelled from the interior cavity via the gas outlet;

wherein the housing is configured to be removably coupled to the storage container to allow the CAPS assembly to be transitioned between installed and uninstalled states relative to the storage container;

wherein the storage container is configured to contain hazardous materials that generate the gas and wherein the CAPS assembly is configured to be sealed against an adjacent surface of the storage container such that the CAPS assembly seals the opening while still allowing the gas to be expelled from the storage container via permeation through the gas-permeable membrane; and wherein the opening comprises a threaded opening and wherein the housing is at least partially threaded such that the housing is configured to be threaded into the threaded opening to removably couple the CAPS assembly to the storage container.

16. A compact augmented permeation system (CAPS) assembly, comprising:

a housing defining an interior cavity, the housing further defining a gas inlet for receiving gas within the interior cavity and a gas outlet for expelling the gas from the interior cavity; and a gas-permeable membrane positioned within the housing and defining a system boundary across the interior cavity such that gas received within the interior cavity via the gas inlet permeates through the gas-permeable membrane before being expelled from the interior cavity via the gas outlet, the gas-permeable membrane including an inner surface and an opposed outer surface;

wherein the inner surface of the gas-permeable membrane has a non-planar configuration as the gas-permeable membrane extends across the interior cavity defined by the housing; and wherein at least a portion of an outer perimeter of the housing is threaded.

17. The material storage system of claim 15, wherein:

the gas-permeable membrane of the CAPS assembly includes an inner surface and an opposed outer surface; and the inner surface of the gas-permeable membrane has a non-planar configuration as the gas-permeable membrane extends across the interior cavity defined by the housing.

18. The material storage system of claim 17, wherein the inner surface of the gas-permeable membrane has a greater surface area than a radial cross-sectional area of the interior cavity.

19. The material storage system of claim 17, wherein the CAPS assembly further comprises at least one support structure positioned within the housing, the at least one support structure being configured to support the gas-permeable membrane in the non-planar configuration.

20. The material storage system of claim 19, wherein the at least one support structure comprises a lower support structure and an upper support structure, the gas-permeable membrane being positioned between the upper and lower support structures with at least a portion of the inner surface of the gas-permeable membrane contacting the lower support structure.

* * * * *